US007294013B2

(12) United States Patent
Nakamura

(10) Patent No.: US 7,294,013 B2
(45) Date of Patent: Nov. 13, 2007

(54) CONNECTOR

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 195 days.

(21) Appl. No.: 11/259,713

(22) Filed: Oct. 26, 2005

(65) Prior Publication Data

US 2006/0086900 A1 Apr. 27, 2006

(30) Foreign Application Priority Data

Oct. 26, 2004 (JP) ..... 2004-311354

(51) Int. Cl.
*H01R 3/00* (2006.01)

(52) U.S. Cl. ..... 439/489

(58) Field of Classification Search ..... 439/489, 439/595, 488, 352
See application file for complete search history.

(56) References Cited

U.S. PATENT DOCUMENTS 5,391,087 A * 2/1995 Fukuda ..... 439/188
5,462,449 A * 10/1995 Tsuji et al. ..... 439/188
5,647,762 A * 7/1997 Fukuda ..... 439/489
5,853,298 A * 12/1998 Pacher ..... 439/352
5,934,946 A * 8/1999 Nakamura ..... 439/752
6,102,732 A * 8/2000 Seko et al. ..... 439/489
6,276,957 B1 * 8/2001 Seko et al. ..... 439/489
6,287,139 B1 * 9/2001 Seko et al. ..... 439/489
6,341,972 B1 * 1/2002 Odorfer ..... 439/352
6,837,733 B2 * 1/2005 Katsuma ..... 439/352
2006/0216984 A1 * 9/2006 Nakamura ..... 439/488
2007/0072482 A1 * 3/2007 Fujii et al. ..... 439/489

FOREIGN PATENT DOCUMENTS

JP 2003-045554 2/2003

* cited by examiner

*Primary Examiner*—John R. Lee
(74) *Attorney, Agent, or Firm*—Gerald E. Hespos; Anthony J. Casella

(57) ABSTRACT

Terminal fittings (21A, 21B) are inserted into cavities (45) of a housing (40) and are locked by locks (28). A cover (70) is mounted on the rear of the housing (40), and is locked by cover locks (60). The cover (70) functions as a retainer by engaging rear surfaces of the terminal fittings (21A, 21B). The cover locks (60) deform towards deformation spaces (60A) if the cover (70) is only partly locked. A detector (100) is insertable through the cover (70) and has detecting pieces (103) that contact the cover locks (60) if the cover locks (60) are in the deformation spaces (60A). Thus, a partly locked state of the cover (70) can be detected. The detecting pieces (103) also enter deformation spaces (50A) for housing locks (50) for locking the housing (40) to a mating housing (11), and can detect a partly locked state of the housings (11, 40).

11 Claims, 30 Drawing Sheets

CONNECTOR

BACKGROUND OF THE INVENTION

1. Field of the Invention

The present invention relates to a cover-fitted connector.

2. Description of the Related Art

Japanese Unexamined Patent Publication No. 2003-45554 discloses a cover that is mounted on the rear surface of a housing of a connector. The cover is held in position by a locking mechanism and functions to hold, bend and protect a group of wires drawn out from the housing.

Some wire covers also contact the rear surfaces of the terminal fittings of the connector to achieve double locking of the terminal fittings in the housing. However, an improperly mounted cover cannot detect whether the terminal fitting has been inserted to a proper position. Hence there is a potential that the terminal fitting may be left insufficiently inserted, and there has been an earnest demand for a countermeasure.

The invention was developed in view of the above problem and an object thereof is to provide a simple construction to detect whether a cover is mounted properly.

SUMMARY OF THE INVENTION

The invention relates to a connector with a housing for receiving at least one terminal fitting and a cover configured to cover at least part of a rear surface of the housing. The connector also includes at least one resiliently deformable cover lock for locking the cover in a mounted state, at least one resiliently deformable housing lock for locking the housing in a properly locked state with a mating housing. A detector is mountable to the housing in an inserting direction. The detector has detecting piece that is insertable into a deformation space for the housing lock and a detecting piece that is insertable into a deformation space for the cover lock as the detector is mounted.

The detector initially is used to detect whether the two housings are connected properly. The housing lock will remain deformed and in its deformation space if the two housings are left partly connected. Thus, the detecting piece for the housing will contact the deformed housing lock to prevent any further insertion of the detector. Thus, the partly connected state of the two housings can be detected efficiently. The cover lock will remain deformed and in its deformation space if the cover is not mounted properly. Thus, the detecting piece for the cover will contact the cover locking piece to prevent any further insertion of the detector, and the partly mounted state of the cover can be detected.

The detector can detect whether the cover is mounted properly and whether the two housings are connected properly. Thus, the connector can have a smaller and simpler construction.

The deformation spaces for the cover lock and the housing lock preferably are on the same path and communicate with each other.

The detector preferably includes a single detecting piece that can be located in both deformation spaces and serves both as the detecting piece for the cover and the detecting piece for the housing. Thus, the detector can be small and the mounting space for the detector also can be small.

The detector can be held at a standby position and at a mounted position reached by inserting the detector further from the standby position.

The detecting piece for the cover preferably is insertable into the deformation space for the cover lock when the detector is at the standby position. Thus, the detecting piece for the cover detects whether the cover is mounted properly. The detecting piece for the housing preferably is insertable into the deformation space for the housing lock when the detector is inserted to the mounted position. Thus, the detecting piece for the housing is inserted into the deformation space for the housing lock to detect whether the two housings are connected properly.

The detecting piece for the cover preferably remains in the deformation space for the cover lock when the detector is at the standby position to hinder inadvertent deformation of the cover lock when the cover is mounted properly. Accordingly, the cover is locked doubly locked in the mounted state when the detector is at the partial locking position. Similarly, the detecting piece for the housing preferably remains in the deformation space for the housing lock when the detector is at the mounted position. Accordingly, the two housings are locked doubly in the properly connected state when the detector is at the full locking position. Thus, movement of the detector to the full locking position simultaneously achieves double locking of the cover and double locking of the housings.

The detecting piece preferably interrupts a short-circuit provided by a shorting element when mounted to the housing at a mounted position.

The connector may be a bent connector in which the direction of the at least one terminal fitting and a wire drawing direction are at an angle, such as a substantially right angle. Alternatively, the connector may be a straight connector in which the direction of the terminal fitting is substantially opposite from the wire drawing direction.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 27:
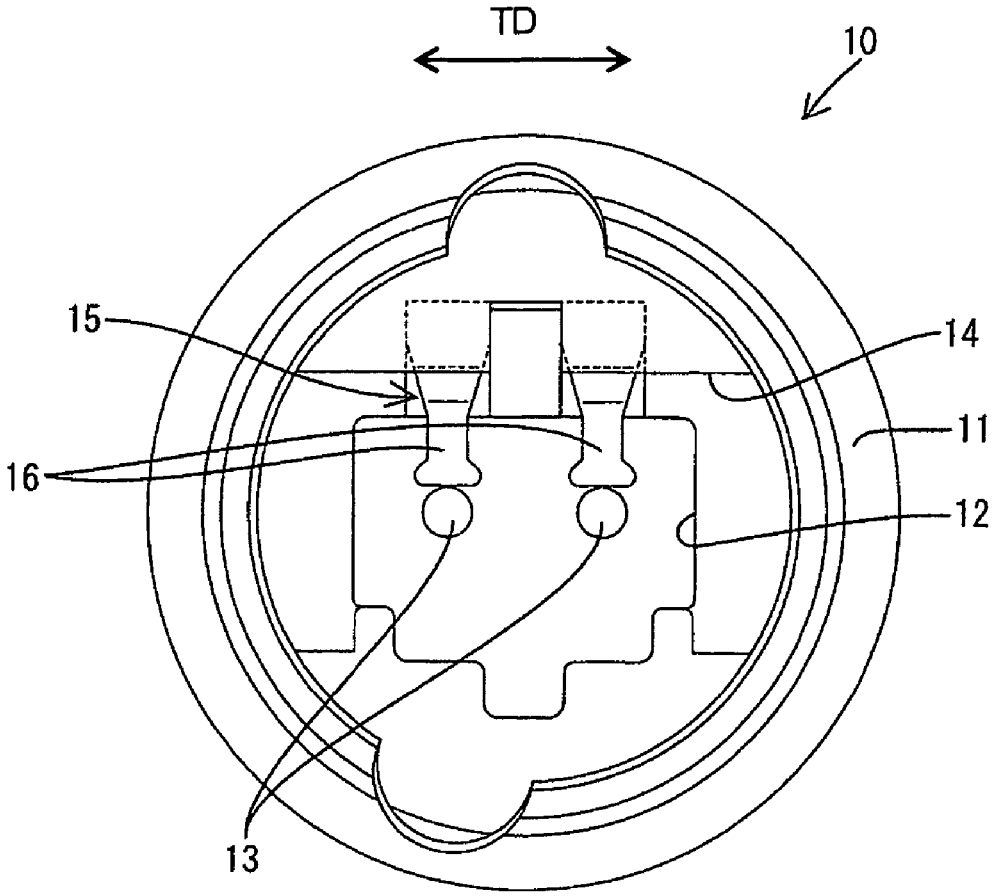
FIG. 27 is a front view of a mating connector.
Figure 30A:
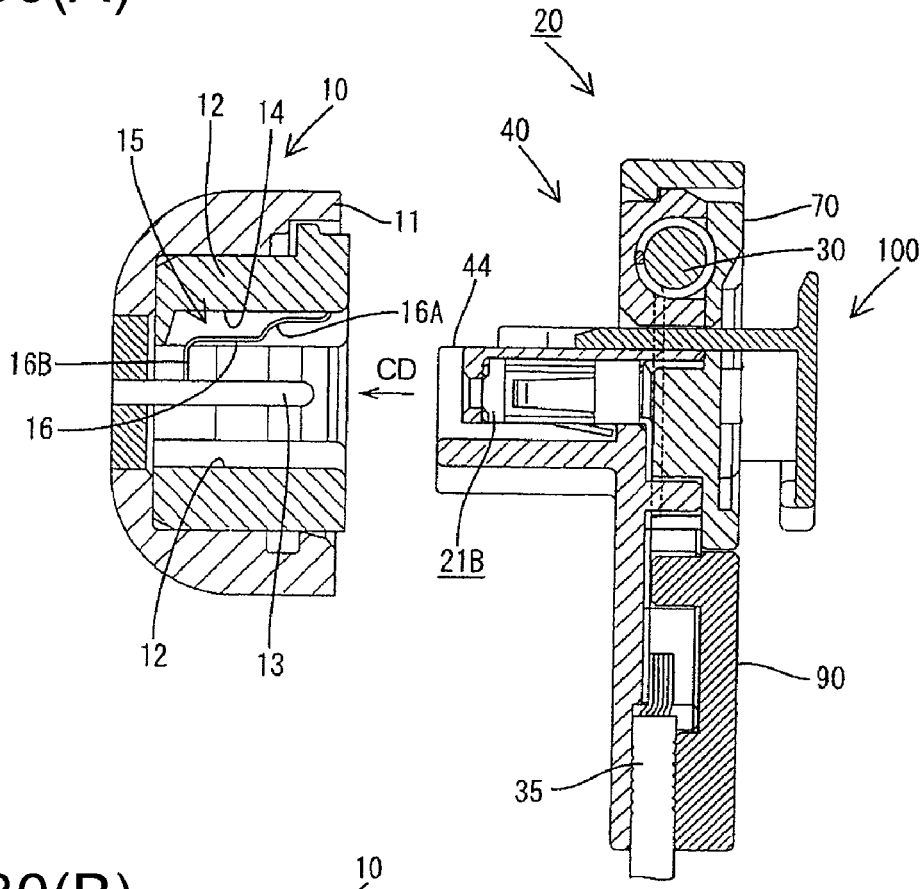
FIGS. 30(A) and 30(B) are vertical and horizontal sections showing a state before the first connector is connected with the mating connector.
Figure 30B:
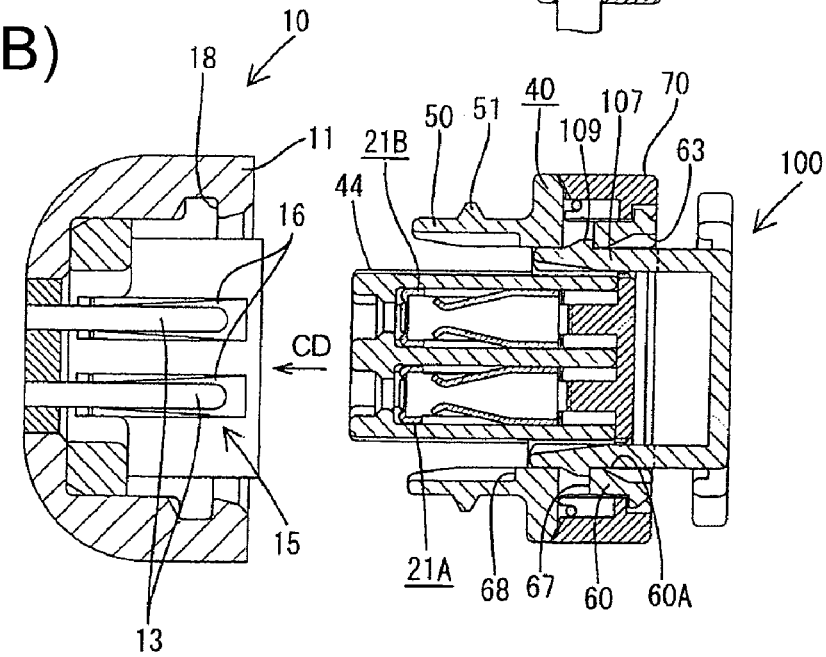

A connector according to the invention is described with reference to the accompanying drawings. In this embodiment the connector is to be connected with a mating connector 10 in an electric or electronic device, such as an airbag device that has a built-in inflator. With reference to FIGS. 27 and 30. The mating connector 10 is directly connected with a device and includes a housing 11 substantially in the form of a thick circular tube that projects integrally or unitarily from a wall of the device. At least one guide is mounted integrally inside the housing 11 and is formed with a guiding hole 12. Two spaced-apart terminal pins 13 project from the back surface of the guiding hole 12 in the housing 11 and are connected with the inflator. The terminal pins 13 are substantially side by side along a transverse direction TD that is substantially normal to a connecting direction CD of the mating connector with the connector.

A slightly raised mounting surface 14 is defined on the ceiling of the guiding hole 12 and receives a shorting terminal 15. The shorting terminal 15 has a front end embedded near a front end of the mounting surface 14. Two contact pieces 16 extend back from the embedded front end of the shorting terminal and are forked at substantially the same interval as the terminal pins 13. Each contact piece 16 includes a downwardly and rearwardly slanted step 16A at an intermediate position. Extending rear ends 16B of the contact pieces 16 extend down at substantially right angles for resilient shorting contact with the terminal pins 13.

The left and right walls of the guiding hole 12 are cut to form locking grooves 18 that extend in a peripheral direction along the inner surfaces of the left and right walls of the housing 11 at positions spaced a specified distance from the front edge, as shown in FIG. 30.

The invention can encompass either of two types of connectors for an inflator. In particular, the connector for the inflator may be a bent connector 20 in which the direction of the terminal fittings facing the mating terminal pins 13 is at an angle to a wire drawing. The connector for the inflator also may be a straight connector 120 in which the direction of the terminal fittings aligns substantially parallel to the wire drawing direction. These two connectors 20, 120 are described below.

Figure 1:
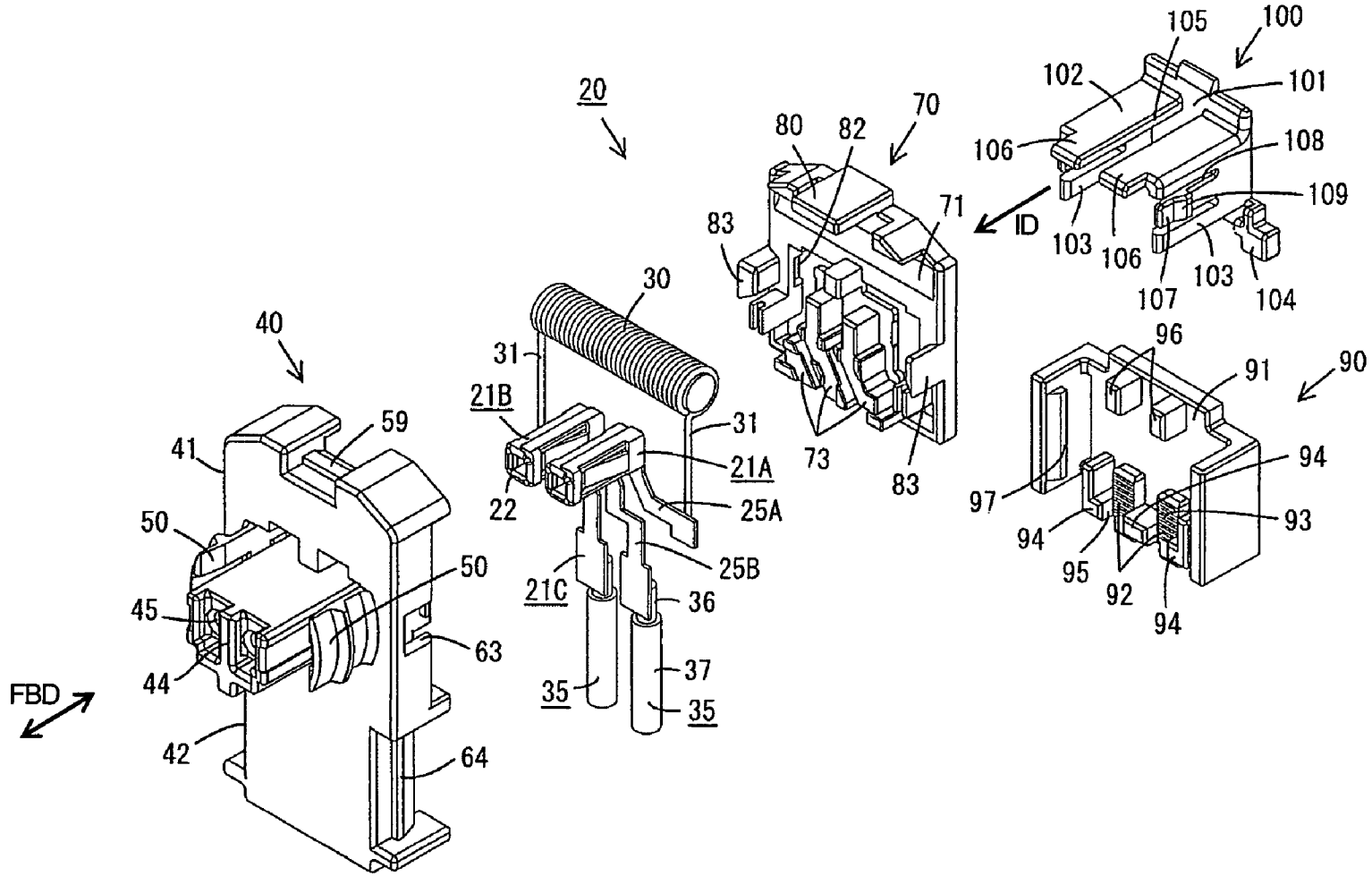
FIG. 1 is an exploded perspective view of a first connector according to one embodiment of the invention.
Figure 2:
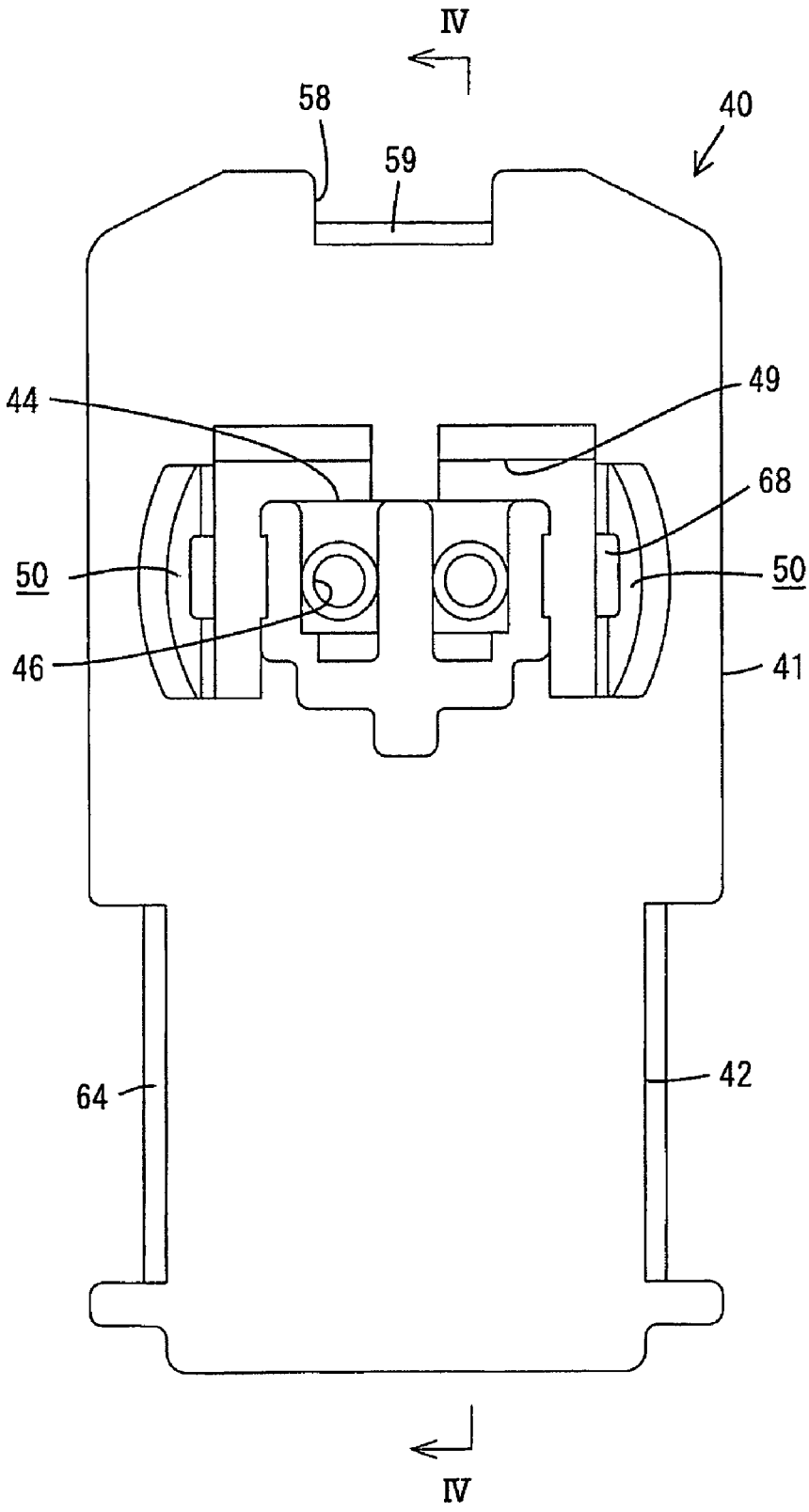
FIG. 2 is a front view of a housing.

As shown in FIG. 1, the first connector 20 has a housing 40, first to third terminal fittings 21A to 21C mountable into the housing 40, a coil 30, first and second covers 70, 90 mounted to the rear surface of the housing 40, and a detector 100 for detecting whether the housing 40 and the housing 11 of the mating connector 10 are connected properly.

The coil 30 functions to remove noise, and two substantially parallel lead wires 31 extend in the same direction from opposite ends of the coil 30.

Each terminal fitting 21 is formed by press-working a conductive plate having a good electrical conductivity, such as a copper alloy plate.

Figure 7:
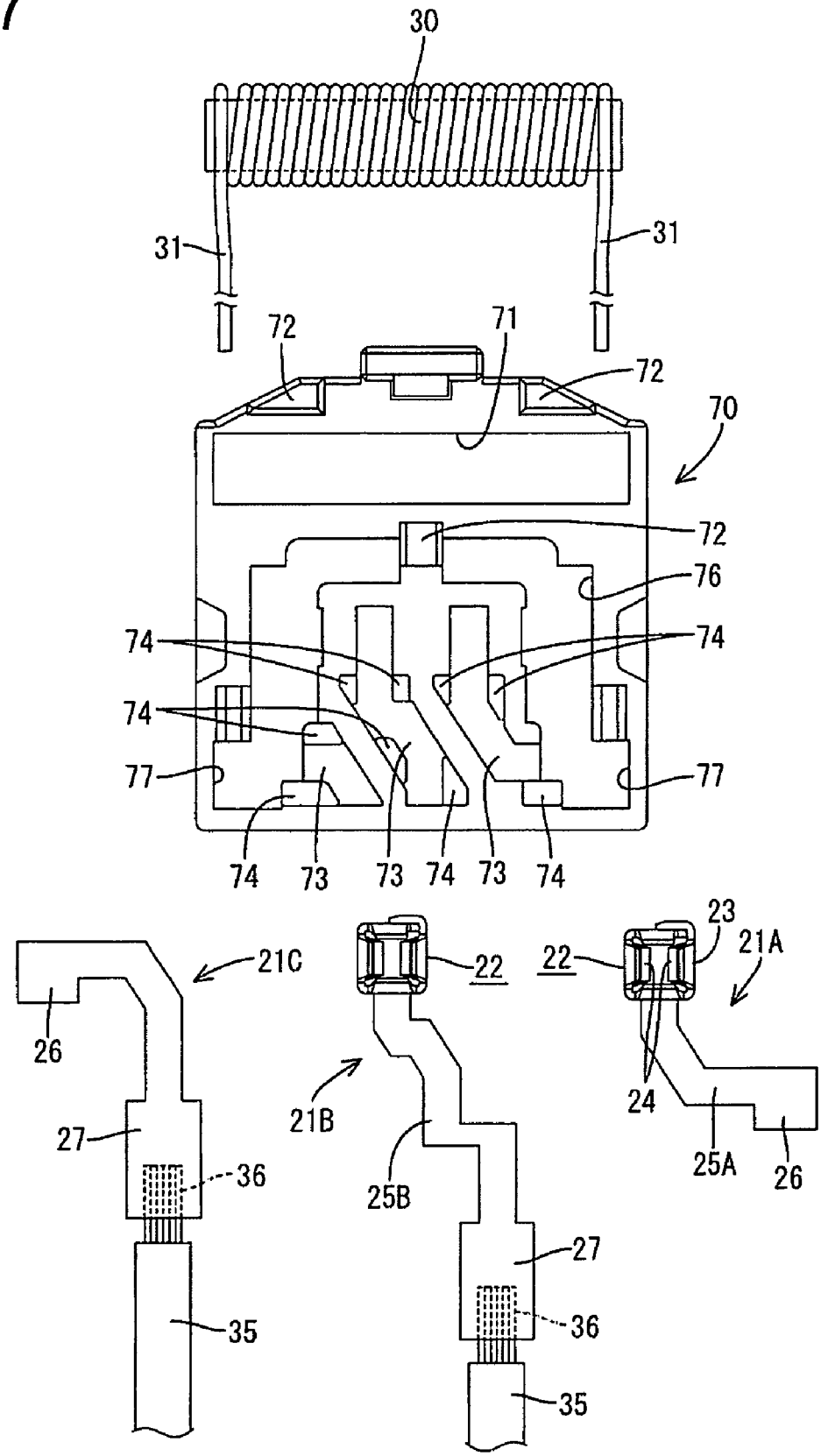
FIG. 7 is a diagram showing a welding operation.

As shown in FIG. 7, the first terminal fitting 21A is formed by embossing, bending and/or folding to define a female connecting portion 22. The female connecting portion 22 has a rectangular tube 23 and two opposed contact pieces 24 project in from left and right surfaces of the tube 23. A lead 25A is provided at the rear end of the female connecting portion 22. The terminal pin 13 can be inserted into the tube 23 for resilient connection with both contact pieces 24. A lock 28 is formed by cutting and bending the bottom plate of the female connecting portion 22 (see FIG. 16).

The busbar-shaped lead 25A is bent down substantially at a right angle from the rear edge of the bottom plate of the tube 23. When viewed from the front (see FIG. 7), the lead 25A extends down a short distance from the tube 23, then extends obliquely down and to right, and then extends to the right. A widened coil welding portion 26 is formed at the lower right for welded connection with one lead wire 31 of the coil 30 as shown in FIG. 7.

The second terminal fitting 21 B also has a busbar-shaped lead 25B bent down at a substantially right angle from the rear end of the tube 23. When viewed from front, the lead 25B extends down a short distance from the tube 23 and then extends right and down in two stages to define a crank-shape. The corner of the lead 25B made by first rightward offset is oblique and parallel with an oblique portion of the lead 25A of the first terminal fitting 21A. The leading end of the lead 25B is widened to define a welding portion 27 for connection with a core 36 of a wire 35.

The third terminal fitting 21C is formed by a busbar or plate cut into a substantially L shape. The ends of the third terminal fitting 21C are substantially perpendicular so that one end faces left and the other end thereof faces down. The corner portion between these ends is substantially oblique and parallel with the oblique portions of the leads 25A, 25B when viewed from the front. A widened coil welding portion 26 is defined at the left-facing end of the third terminal fitting 21C for welded connection to the other lead wire 31 of the coil 30. A widened welding portion 27 faces down at the right end of the third terminal fitting 21C for welded connection to a core 36 of the other wire 35.

The housing 40 is made e.g. of a synthetic resin, such as PBT (polybutylene terephthalate), and is a vertically long thick plate with an upper end that is widened via steps, as shown in FIGS. 2 to 5. The upper end of the housing 40 is a terminal accommodating portion 41 and the lower end is a wire accommodating portion 42. A tower 44 projects from the front surface of the terminal accommodating portion 41 at an intermediate position with respect to the height direction and is configured to fit into the guiding hole 12 of the mating connector 10. Two cavities 45 are formed in the tower 44 side by side along a transverse direction TD at substantially the same intervals as the terminal pins 13. The female connecting portions 22 of the first and second terminal fittings 21A, 21B can be inserted into the cavities 45 from behind.

A terminal insertion opening 46 is formed in the front wall of each cavity 45 for receiving the mating terminal pin 13. An engaging portion 47 is formed on the bottom of each cavity 45 for resiliently engaging the metal lock 28 when the female connecting portion 22 has been inserted to a proper position.

Insertion paths 49 for the detector 100 are formed around the tower 44 in areas except the left and right sides and an upper intermediate side. The insertion paths 49 penetrate the housing 40 substantially in forward and backward directions FBD. Housing locks 50 project at outer sides of the left and right insertion paths 49 on the front surface of the terminal accommodating portion 41 for locking the housing 40 and the housing 11 of the mating connector 10 together. Each housing lock 50 has an arcuate outer surface configured for insertion along the inner peripheral surface of the mating housing 11. An elongated locking projection 51 is formed on the outer surface of each lock 50 and has a substantially triangular or polygonal cross section. The leading end of the housing lock 50 is resiliently deformable towards the insertion path 49 at the inner side so that the locking projection 51 can fit into the corresponding locking groove 18 of the mating housing 11.

Figure 3:
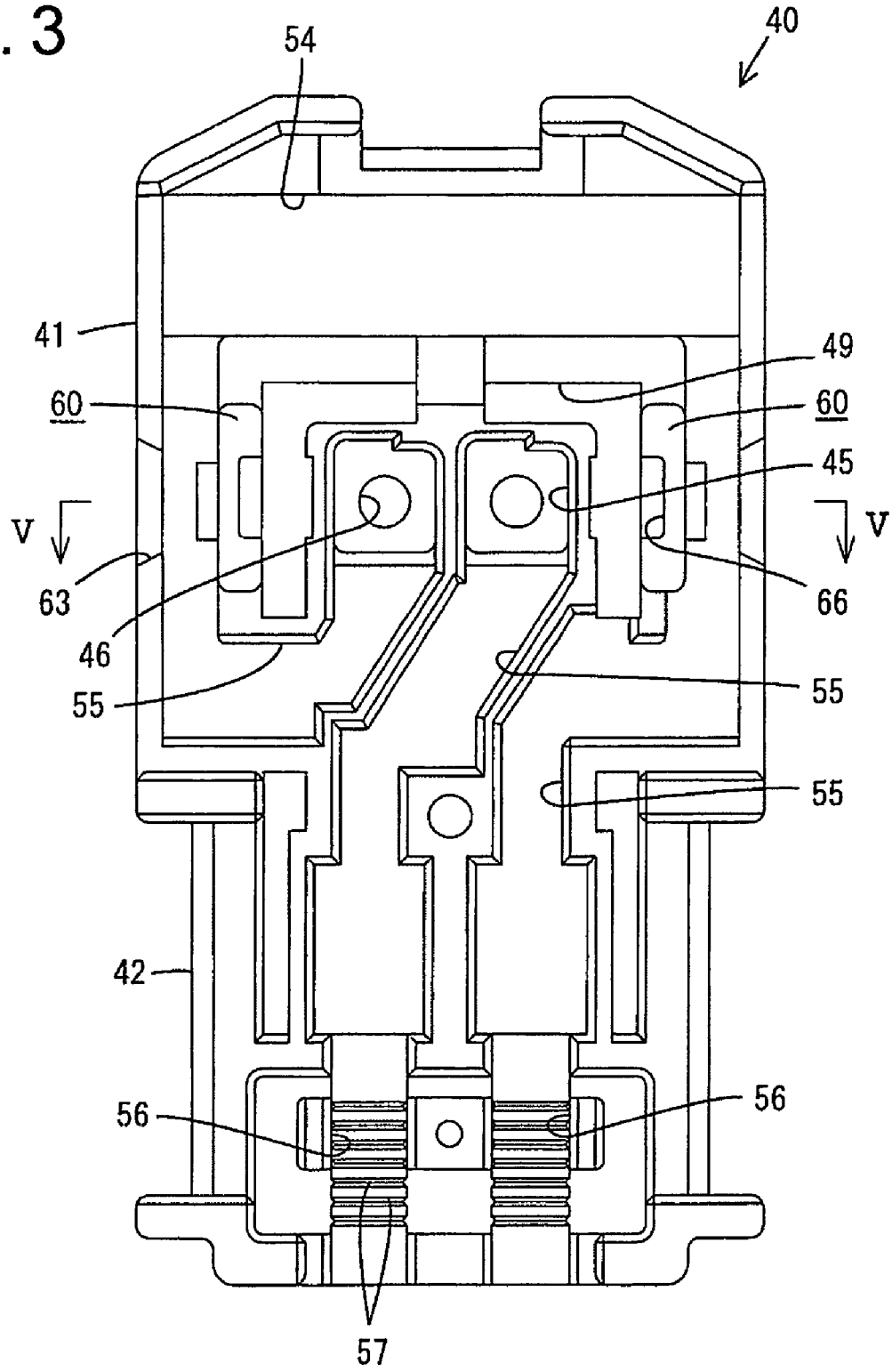
FIG. 3 is a rear view of the housing.
Figure 6:
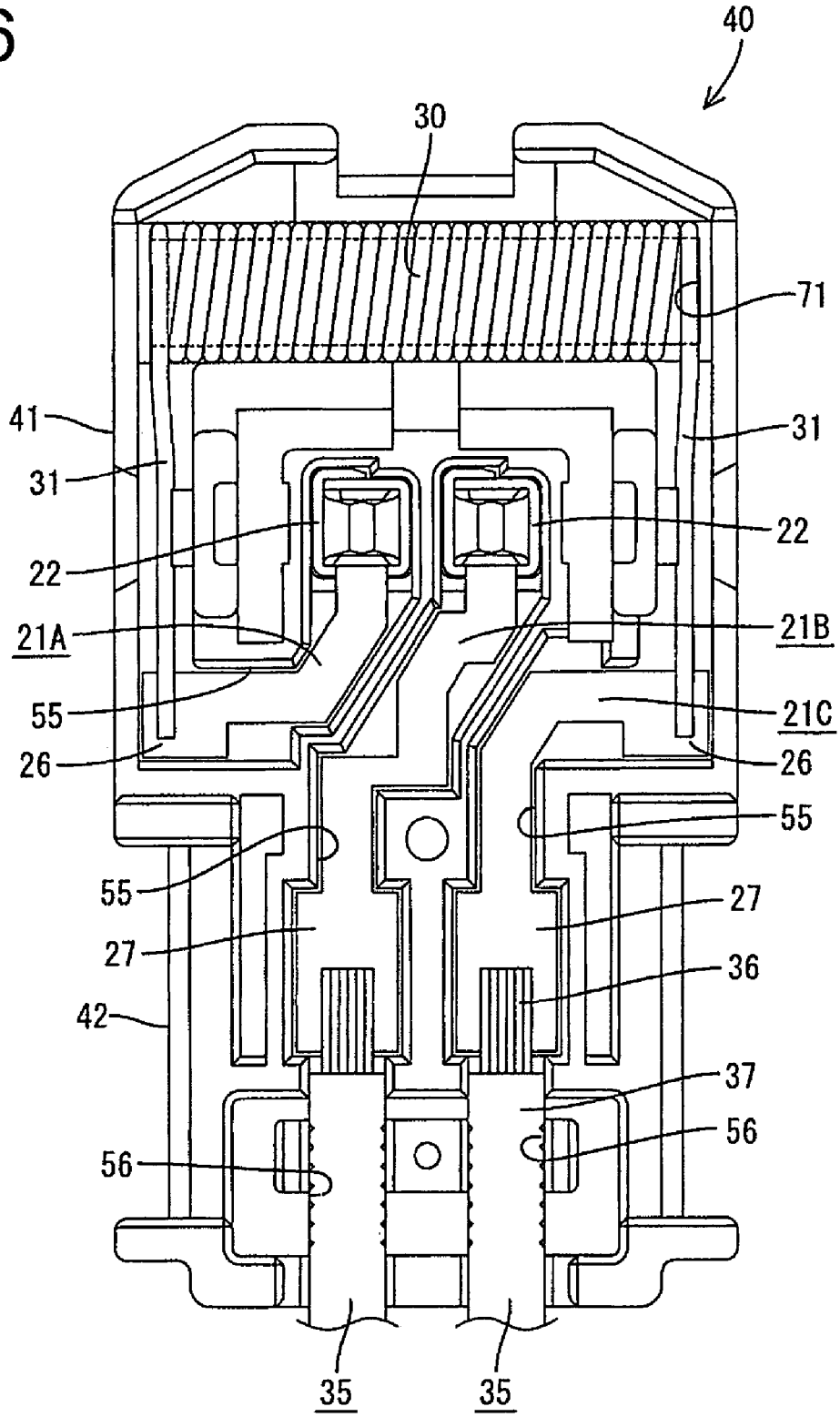
FIG. 6 is a rear view of the first connector with covers detached.

A coil accommodating recess 54 is formed in the rear surface of the housing 40 and along the upper edge of the terminal accommodating portion 41 for accommodating the coil 30. Terminal accommodating grooves 55 are formed from the bottom of the terminal accommodating portion 41 to the top of the wire accommodating portion 42, as shown in FIGS. 3 and 6, for accommodating the leads 25A, 25B of the first and second terminal fittings 21A, 21B and the third terminal fitting 21C.

Two wire accommodating grooves 56 are formed at bottom ends of the wire accommodating portion 42 for accommodating ends of insulation coatings 37 of the wires 35. The wire accommodating grooves 56 are substantially continuous with the terminal accommodating grooves 55 and have open bottom ends. Biting projections 57 are formed at intervals along longitudinal direction at the bottoms of the terminal accommodating grooves 55.

The first and second covers 70 and 90 are mounted respectively on the rear surface of the terminal accommodating portion 41 of the housing 40 and the rear surface of the wire accommodating portion 42. Both covers 70, 90 are made e.g. of a synthetic resin such as PBT similar to the housing 40.

The first cover 70 at covers the rear surface of the terminal accommodating portion 41 and presses the rear surfaces of the female connecting portions 22 of the first and second terminal fittings 21A, 21B to doubly lock the female connecting portions 22.

On the other hand, the wires 35, the first to third terminal fittings 21A to 21C and the coil 30 are arranged at specified positions and connected by welding, clamping, soldering, press-fitting or the like. This assembling operation is performed using the first cover 70.

Figure 8:
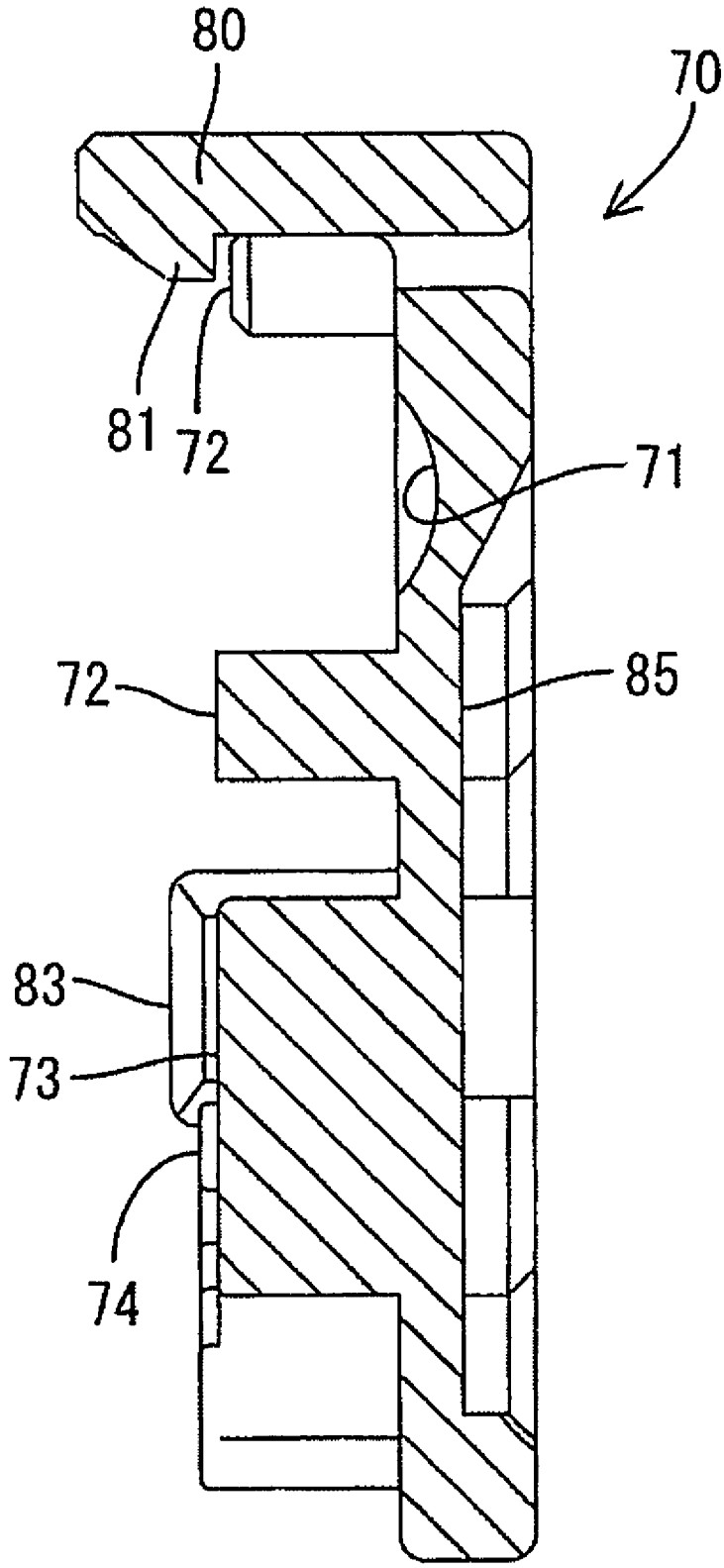
FIG. 8 is a vertical section of a first cover.

To this end, the inner surface of the first cover 70 is formed with a holding recess 71 for the coil 30 at a position substantially along the upper edge, and positioning portions 72 for holding the coil 30 therebetween project at the upper and lower sides of the holding recess 71, as shown in FIGS. 7 and 8. Three placing portions 73 are elevated or project in a widthwise intermediate area near the bottom of the inner surface of the first cover 70 for receiving parts of the first terminal fittings 21A, 21B from the rear surfaces of the female connecting portions 22 to the lead portions 25A, 25B and a part of the third terminal fitting 21C. Positioning projections 74 are formed at substantially opposite sides of the outer surfaces of the respective placing portions 73 for holding at lest part of the placed parts therebetween.

Windows 76 are formed near placing portions 73 and at positions corresponding to the insertion paths 49 of the housing 40. The windows 76 are disposed and configured for receiving the detector 100. The left and right windows 76 are wider in outward directions than the insertion paths 49. Openings 77 for welding or other such connection communicate with the bottom ends of the left and right windows 76 at obliquely outward positions.

Figure 9:
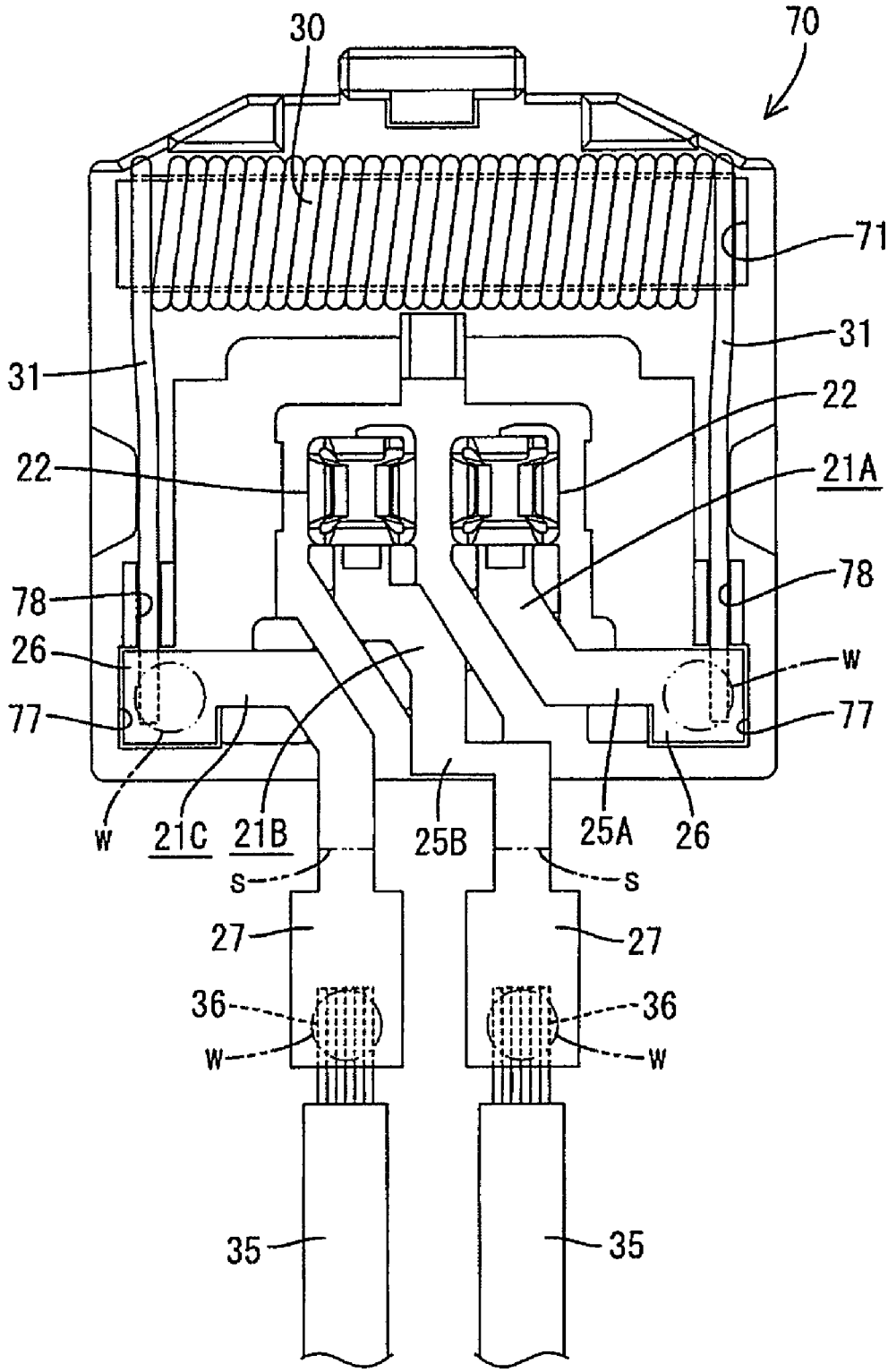
FIG. 9 is a rear view of the first cover with a welded assembly mounted.

The first cover 70 can be arranged on a setting table of an automatic welding apparatus (not shown) as shown in FIG. 9. The coil 30 then is placed in the holding recess 71 and both lead wires 31 are laid along the left and right edges of the first cover 70 so that the leading ends reach the respective openings 77 for welding. Portions of the lead wires 31 before the leading ends are fit into holding grooves 78. Thus, the leading ends of the lead wires 31 close to the openings 77 are at substantially the same height as the outer surfaces of the placing portions 73.

The first to third terminal fittings 21A to 21C then are positioned on the placing portions 73. The welding portion 26 of the lead 25A of the first terminal fitting 21A is at one opening 77 and substantially on the leading end of one lead wire 31 of the coil 31. The welding portion 26 of the third terminal fitting 21C is at the other opening 77 and substantially on the leading end of the other lead wire 31 of the coil 30.

Simultaneously, the wire welding portion 27 of the lead 25B of the second terminal filling 21B and that of the third terminal fitting 21C project down from the first cover 70 while being spaced apart.

The ends of the cores 36 of the wires 35 then are brought into contact with the undersides of the corresponding wire welding portions 27, and a total of four placed portions are connected by spot welding at location "w" in FIG. 9. Thus, the ends of the two wires 35, the first to third terminal fittings 21A to 21C and the coil 30 are connected and assembled in a specified layout.

Figure 4:
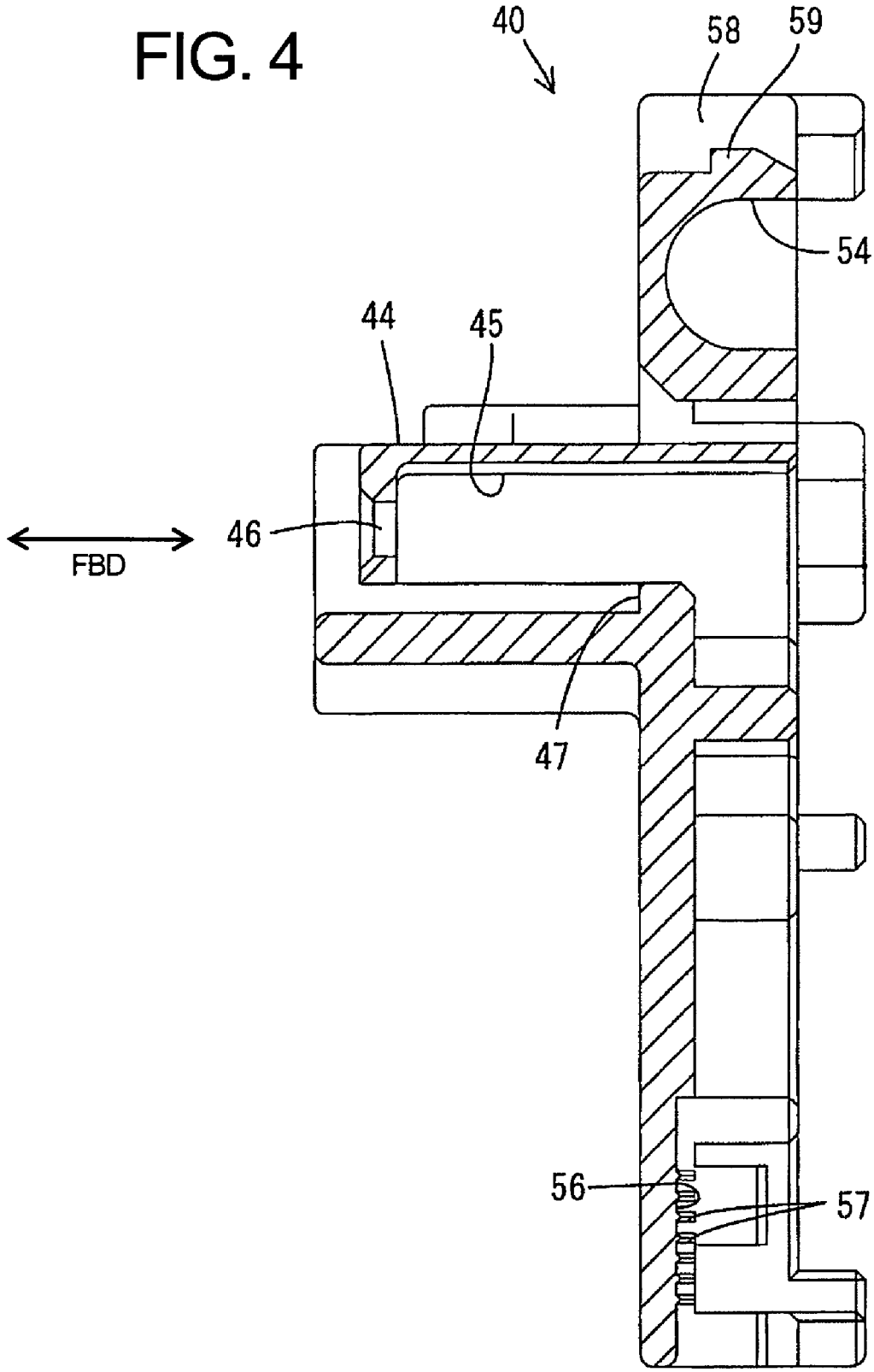
FIG. 4 is a section along IV-IV of FIG. 2.

A locking construction for locking the first cover 70 in a mounted state is as follows. A resiliently deformable upper locking piece 80 projects forward from the upper edge of the first cover 70, and a groove 58 is formed in the upper surface of the housing 40 for receiving the upper locking piece 80. A latch 59 is formed at the bottom end of the groove 58, as shown in FIG. 4, and is engageable with a hook 81 on the upper locking piece 80.

Figure 5:
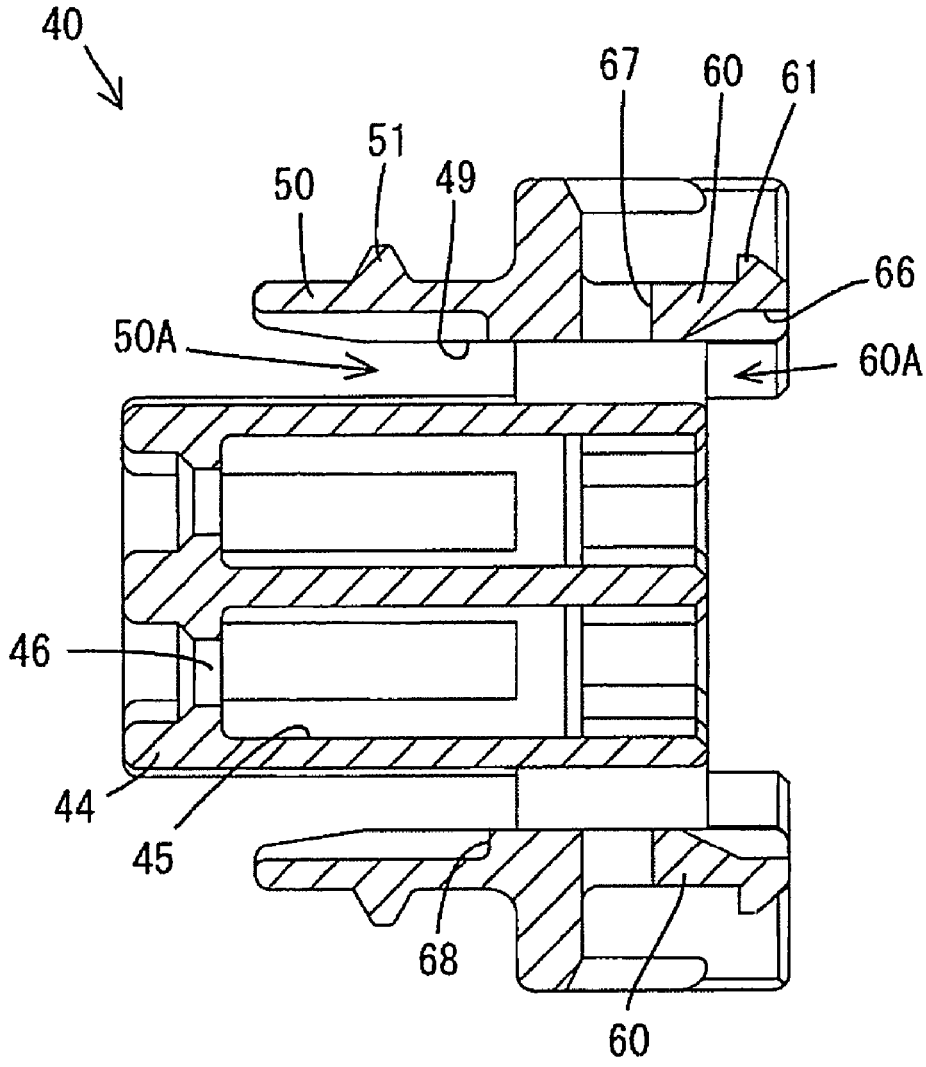
FIG. 5 is a section along V-V of FIG. 3.

Two cover locks 60 project from the rear surface of the terminal accommodating portion 41 of the housing 40. As shown in FIG. 5, each cover lock 60 is at a position behind the corresponding housing lock 50. A hook-shaped lock projection 61 is formed on the outer surface of the leading end each cover lock 60, and the leading end of each cover lock 60 is resiliently deformable in towards the insertion path 49. On the other hand, as shown in FIGS. 1 and 28(B), lock grooves 82 are formed at the outer edges of the windows 76 in the first cover 70, and the lock projections 61 of the cover locks 60 engage with the corresponding lock grooves 82 when the first cover 70 is mounted properly.

Two guide ribs 83 project from the opposite left and right edges of the inner surface of the first cover 70, and are received in guide grooves 63 in the left and right edges of the rear surface of the housing 40.

Figure 10:
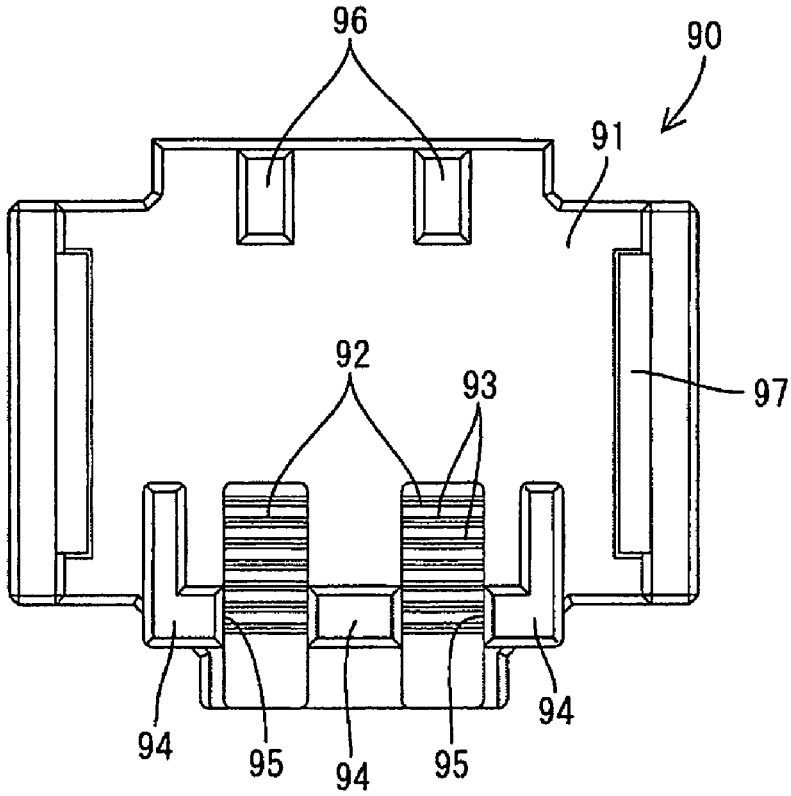
FIG. 10 is a rear view of a second cover.
Figure 11:
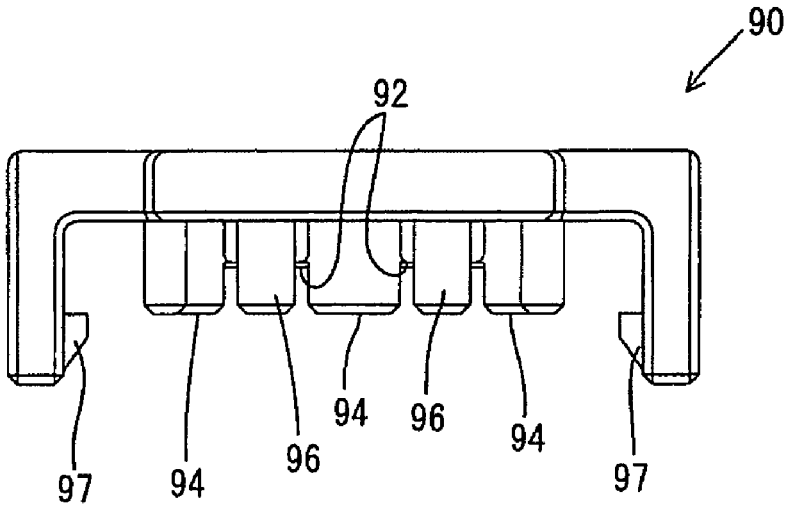
FIG. 11 is a plan view of the second cover.
Figure 12:
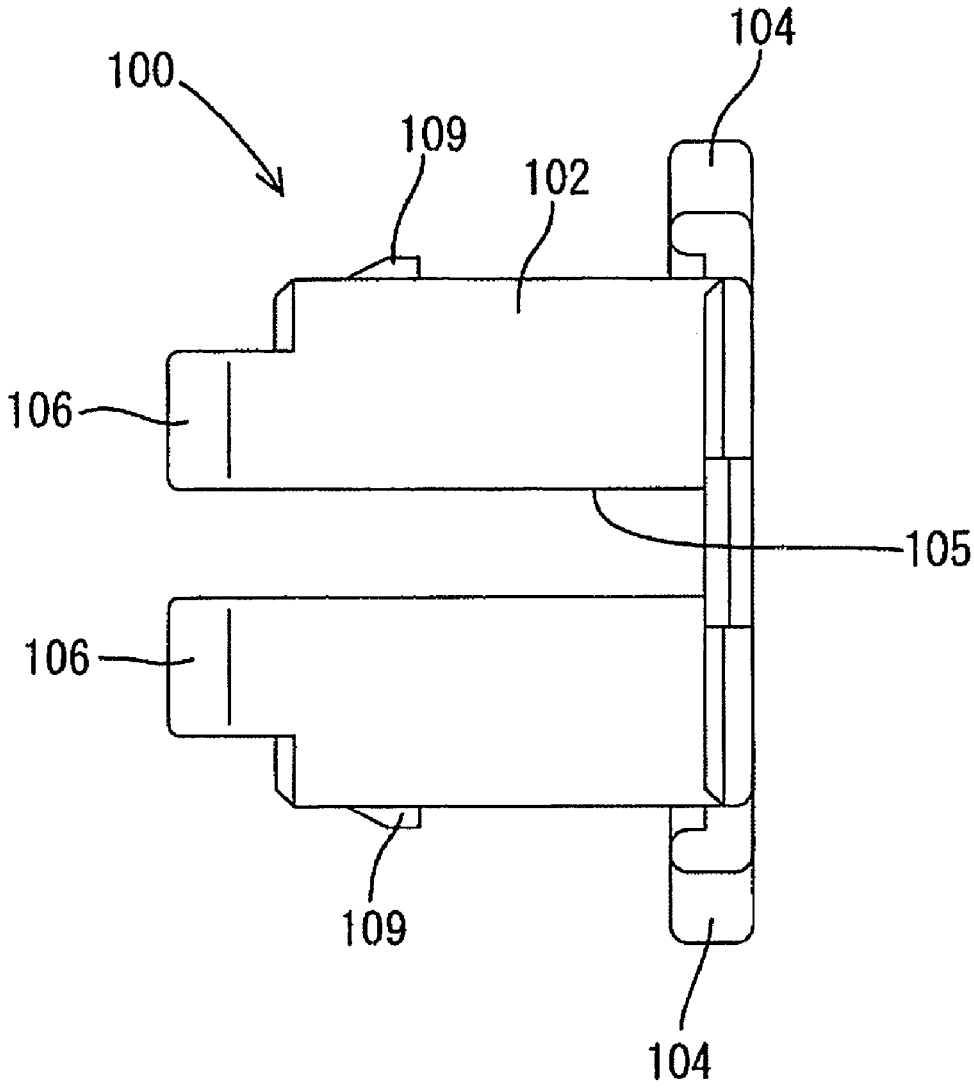
FIG. 12 is a plan view of a detecting member.
Figure 13:
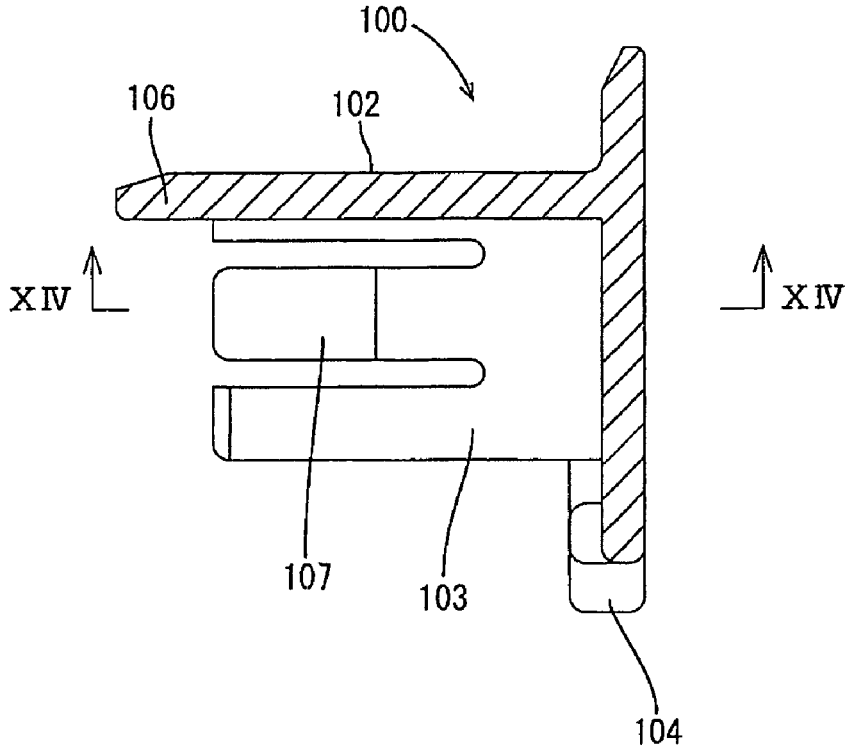
FIG. 13 is a vertical section of the detecting member.
Figure 14:
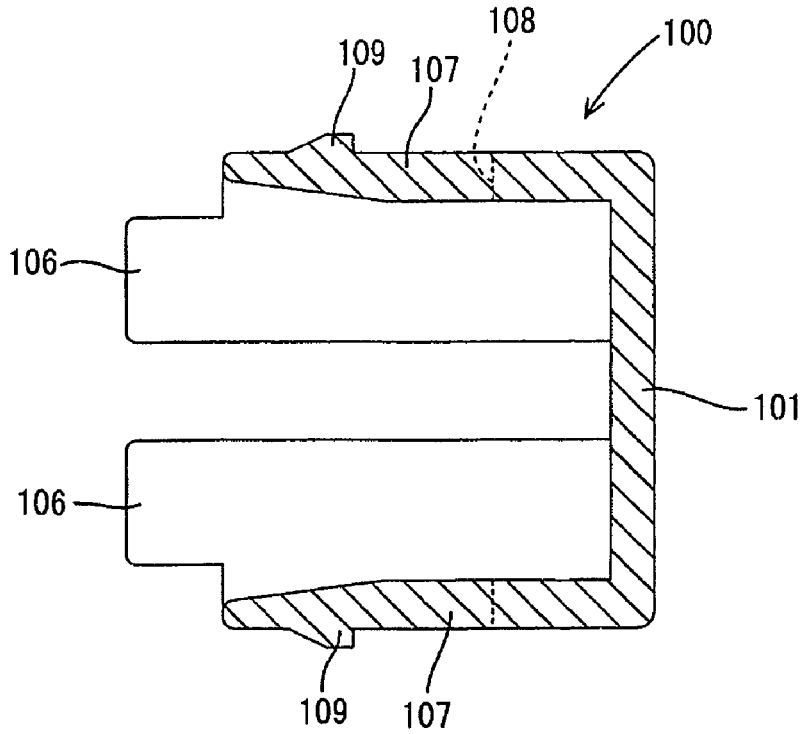
FIG. 14 is a section along XIV-XIV of FIG. 13.
Figure 15:
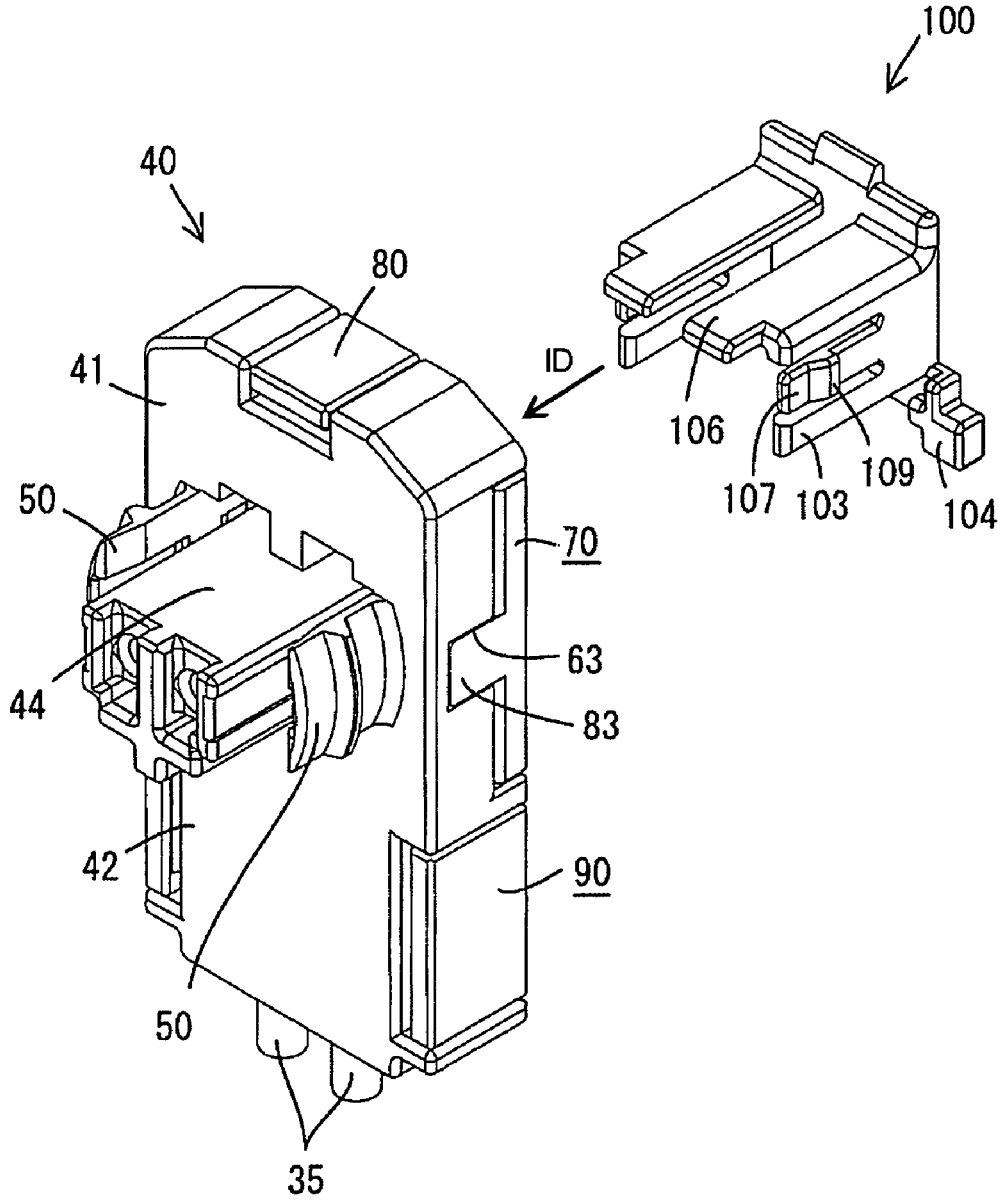
FIG. 15 is a perspective view showing a state after the first connector is assembled, but before the detecting member is mounted.

The second cover 90 is mounted to cover the rear, left and right surfaces of the wire accommodating portion 42 to hold the ends of the ends of the insulation coatings 37 of the wires 35. The second cover 90 has a main plate 91 and two squeezing portions 92 project at bottom positions of the inner surface of the main plate 91, as shown in FIGS. 10 and 11, for cooperating with the wire accommodating grooves 56 of the housing 40 to hold the ends of the insulation coatings 37 of the wires 35. Biting projections 93 are formed on the outer surface of each squeezing portion 92. Spacers 94 stand between and at the outer sides of the two squeezing portions 92, and draw-out openings 95 for the wires 35 are defined near the spacers 94. Further, pressing portions 96 project at upper end positions of the inner surface of the main plate 91 for pressing the lead 25B of the second terminal fitting 21B and an upper part of the wire welding portion 27 of the third terminal fitting 21C against the terminal accommodating grooves 55.

Elongated lock projections 97 are formed near the projecting edges of the inner surfaces of the side plates of the second cover 90, and engaging projections 64 are formed on outer surfaces of the side walls of the wire accommodating portion 42 of the housing 40 to engage the lock projections 97.

The detector 100 is mountable on the rear surface of the first cover 70. The detector 100 also is made e.g. of a synthetic resin such as PBT. As shown in FIGS. 12 to 15, the detector 100 has an upper wall 102 that is insertable into the insertion paths 49 through the windows 76 of the first cover 70 and left and right detecting pieces 103 project from the front surface of a base plate 101 for at least partly covering the windows 76 in the first cover 70.

A mounting recess 85 is formed in the rear surface of the first cover 70 for receiving the base plate 101 of the detector 100 so that the base plate 101 is substantially flush with the rear surface of the first cover 70. Lids 104 are formed at the opposite bottom corners of the base plate 101 for at least partly closing the openings 77 of the first cover 70.

An escaping groove 105 is formed at a widthwise intermediate position in the upper wall 102 of the detector 100 so that closed parts at the upper sides of the windows 76 and the insertion paths 49 can escape. Two disengaging pieces 106 project at the opposite sides of the escaping groove 105 at the leading end of the upper wall 102. The disengaging pieces 106 engage the contact pieces 16 of the shorting terminal 15 to resiliently deform the contact pieces 16 towards the mounting surface 14 when the detector 100 is pushed to a full locking position.

Each detecting piece 103 has a holding piece 107 for holding the detector 100 at a partial locking position and the full locking position with respect to the housing 40. Each holding piece 107 is cantilevered substantially forward in a projecting direction of the tower 44 by making upper and lower slits 108 in the detecting piece 103. The inner surface of the leading end of each holding piece 107 is slanted or rounded to taper the leading end. The holding pieces 107 are resiliently deformable inwardly to bring their leading ends closer to each other. A holding projecting 109 is formed on the outer surface of the leading end of each holding piece 107. Each holding projection 109 has a standing rear surface and a slanted front surface.

Both detecting pieces 103 slide substantially along the inner surfaces of the cover locks 60 and the housing locks 50 of the housing 40 for successively entering the deformation spaces 60A, 50A for the locks 60, 50 as the detector 100 is inserted through the windows 76 of the first cover 70 and into the insertion paths 49 of the housing 40.

Insertion grooves 66 are formed in the inner surfaces of the cover locking pieces 60 and extend a specified distance from the projecting ends for permitting insertion of the holding projections 109 of the holding pieces 107. Partial locking holes 67 are formed at the backs of the insertion grooves 66, as shown in FIG. 5, for receiving the holding projections 109. Further, full locking holes 68 are formed in the inner surfaces of the base ends of the housing locking pieces 50 at further backward positions with respect to the inserting direction ID of the detector 100 for receiving the holding projections 109.

Figure 31A:
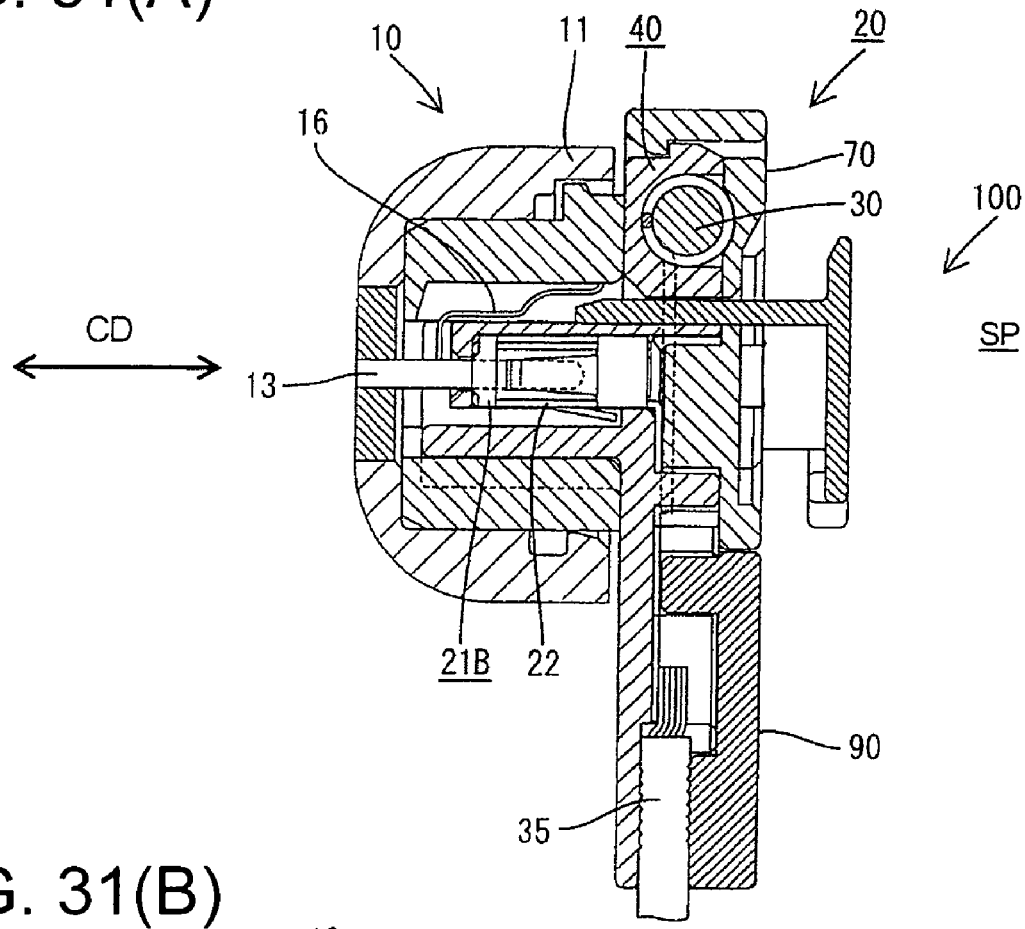
FIGS. 31(A) and 31(B) are vertical and horizontal sections showing a state where the first connector is connected with the mating connector.
Figure 31B:
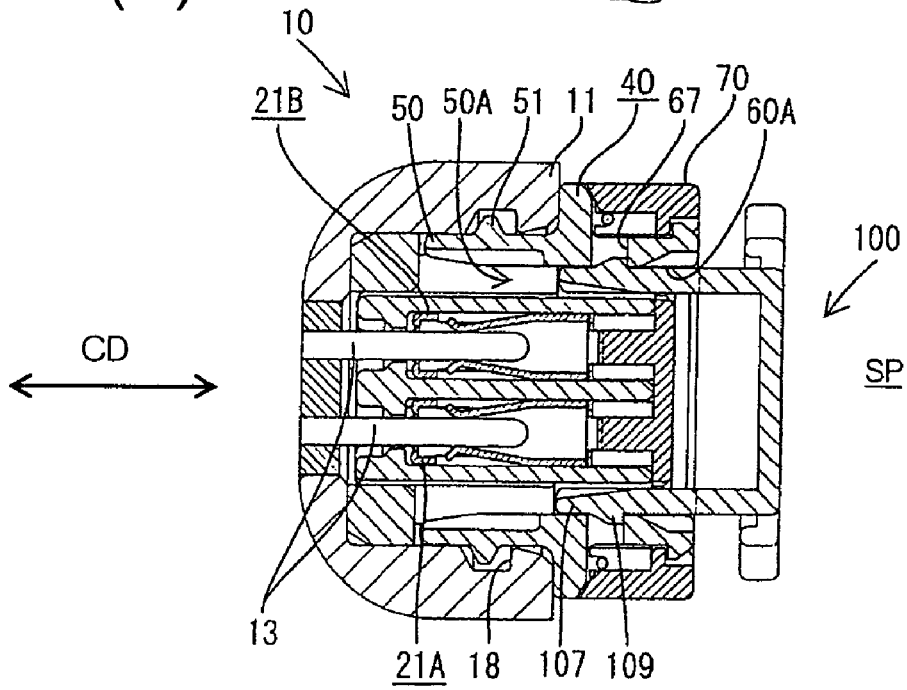

Accordingly, the detector 100 is inserted in the inserting direction ID so that the holding projectings 109 of the holding pieces 107 first fit in the partial locking holes 67 to hold the detector 100 temporarily at a partial locking position SP, as shown in FIG. 31(B). Thus, the detecting pieces 103 are in the deformation spaces 60A for the cover locking pieces 60, but are before the deformation spaces 50A for the housing locking pieces 50 to permit the resilient deformations of the housing locking pieces 50.

Figure 33A:
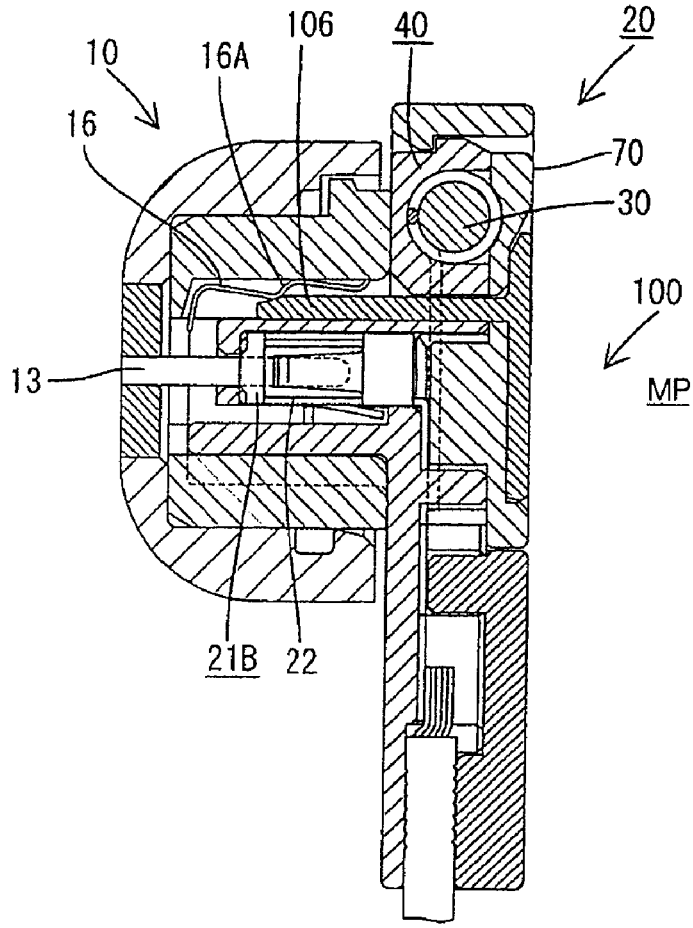
FIGS. 33(A) and 33(B) are a vertical section and a horizontal section showing a state where the detector is held at a full locking position.
Figure 33B:
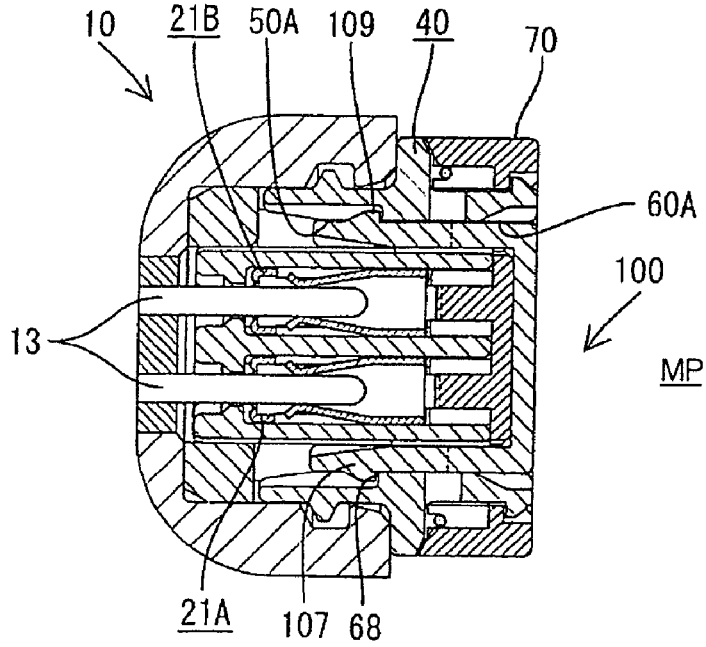

The detector 100 then can be pushed further so that the holding projections 109 fit into the full locking holes 68, as shown in FIG. 33(B) to hold the detector 100 at the full locking position MP. Thus, the detecting pieces 103 are in the deformation spaces 50A for the housing locking pieces 50 and the rear sides of the detecting pieces 103 are in the deformation spaces 60A for the cover locking pieces 60. Further, the disengaging pieces 106 on the upper wall 102 are at disengaging positions for contacting the contact pieces 16 of the shorting terminal 15 mounted in the housing 11 when the housing 40 is connected with the housing 11 of the mating connector 10.

Figure 18:
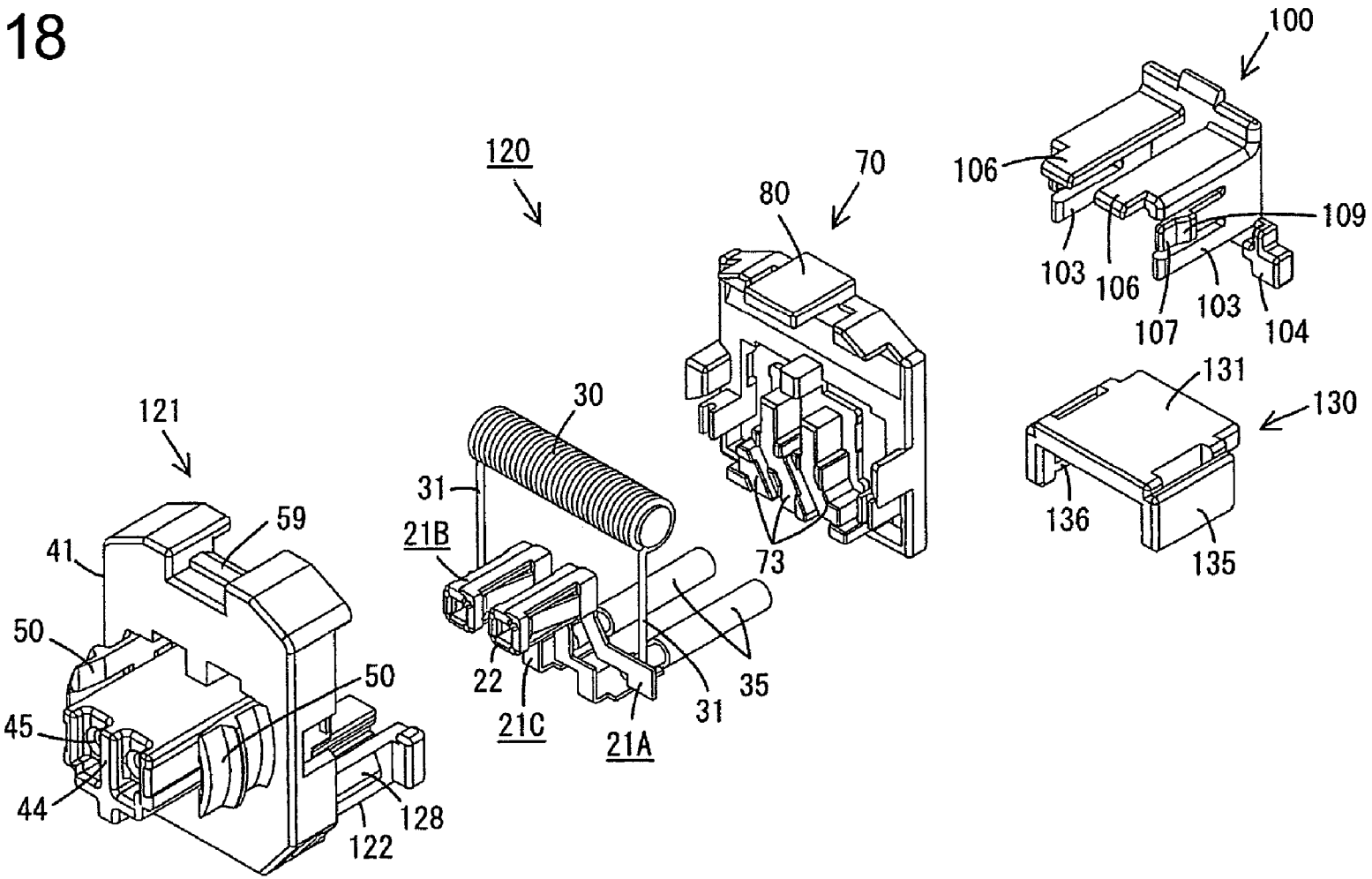
FIG. 18 is an exploded perspective view of a second connector.

The second connector 120 is referred to as a straight connector because the female connecting portions 22 of female terminal fittings 21 extend opposite from the drawing direction of wires 35, as shown in FIG. 18.

Figure 24:
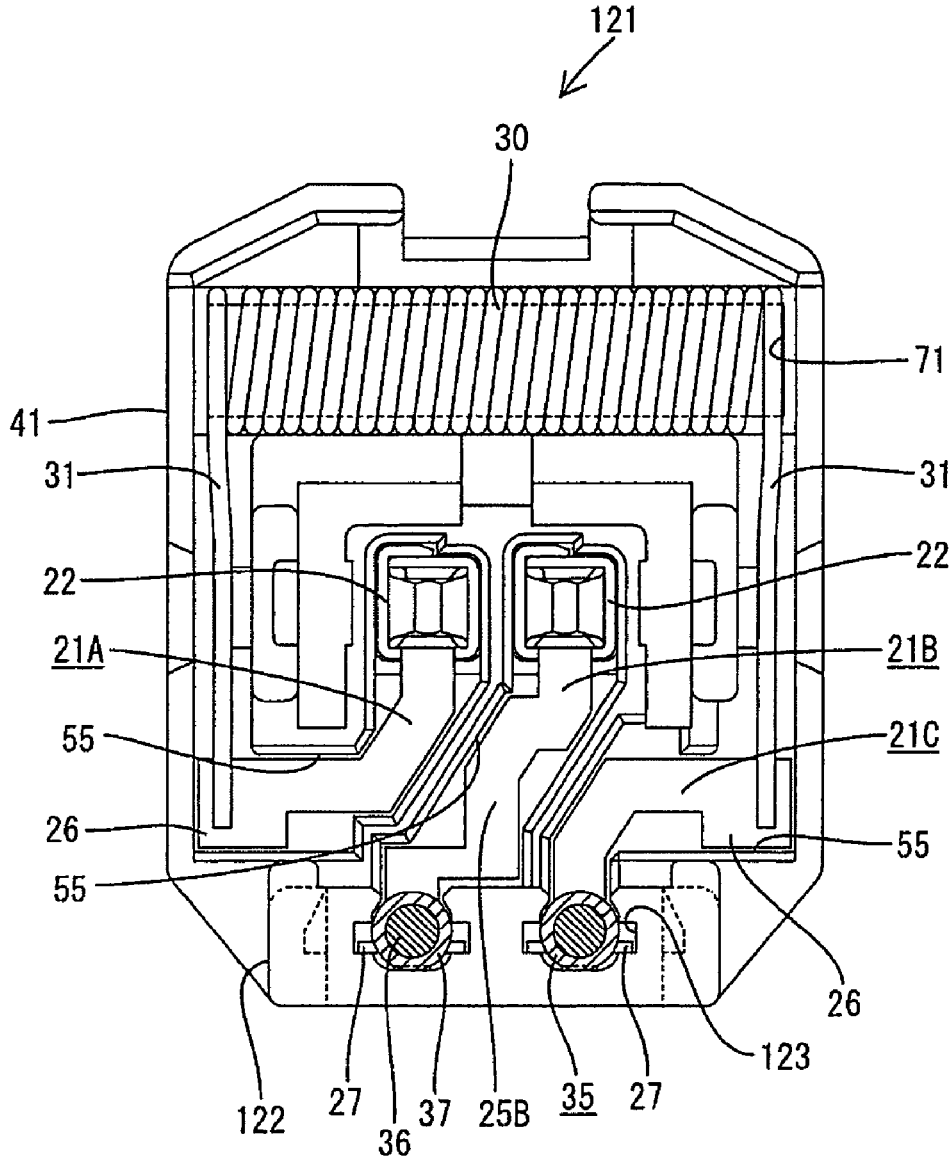
FIG. 24 is a rear view showing a state of the second connector with the cover detached.
Figure 25:
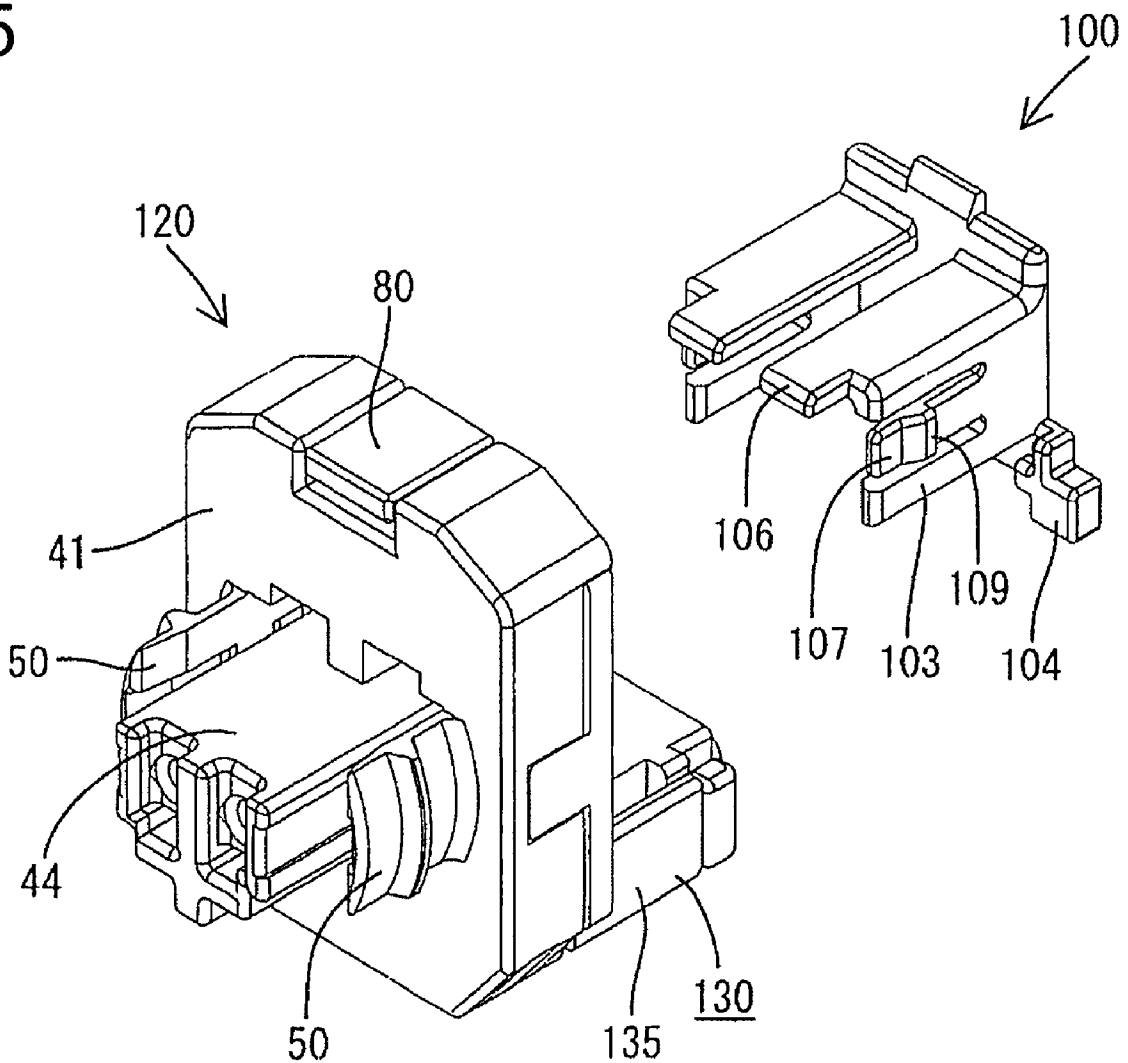
FIG. 25 is a perspective view showing a state after the second connector is assembled, but before the detecting member is mounted.

The second connector 120 differs from the first connector 20 in that a lead 25B of a second terminal fitting 21B and a third terminal fitting 21C are bent substantially at right angles at positions above wire welding portions 27, as also shown in FIG. 24, during an assembling operation. Accordingly, the shapes of a housing 121 and third cover 130 to be mounted on a wire accommodating portion 122 differ from those of the first connector 20. On the other-hand, the first cover 70 to be mounted on or to a terminal accommodating portion 41 and the detector 100 are commonly used.

The second connector 120 is assembled by arranging wires 35, the first to third terminal fittings 21A to 21C and a coil 30 in a specified manner on the first cover 70 as shown in FIG. 9. These components then are connected by welding, soldering, press-fitting, clamping or the like, similar to the assembly of the first connector 20. The lead 25B of the second terminal fitting 21B then is bent at a right angle along a bending line "s" at a position above the wire welding portion 27 and the third terminal fitting 21C is bent at a right angle along a bending line "s" at a position above the wire welding portion 27, as shown in chain line in FIG. 9. Thus, the assembly of the second connector 120 differs from that of the first connector 20 only in that the second and third terminal fittings 21B, 21C are bent substantially in an L-shape at a final stage. However, most constituent parts of the second connector are similar or identical to those of the first connector 20, and only the housing 121 and the third cover 130 differ substantially from the corresponding parts of the first connector 20.

Figure 19:
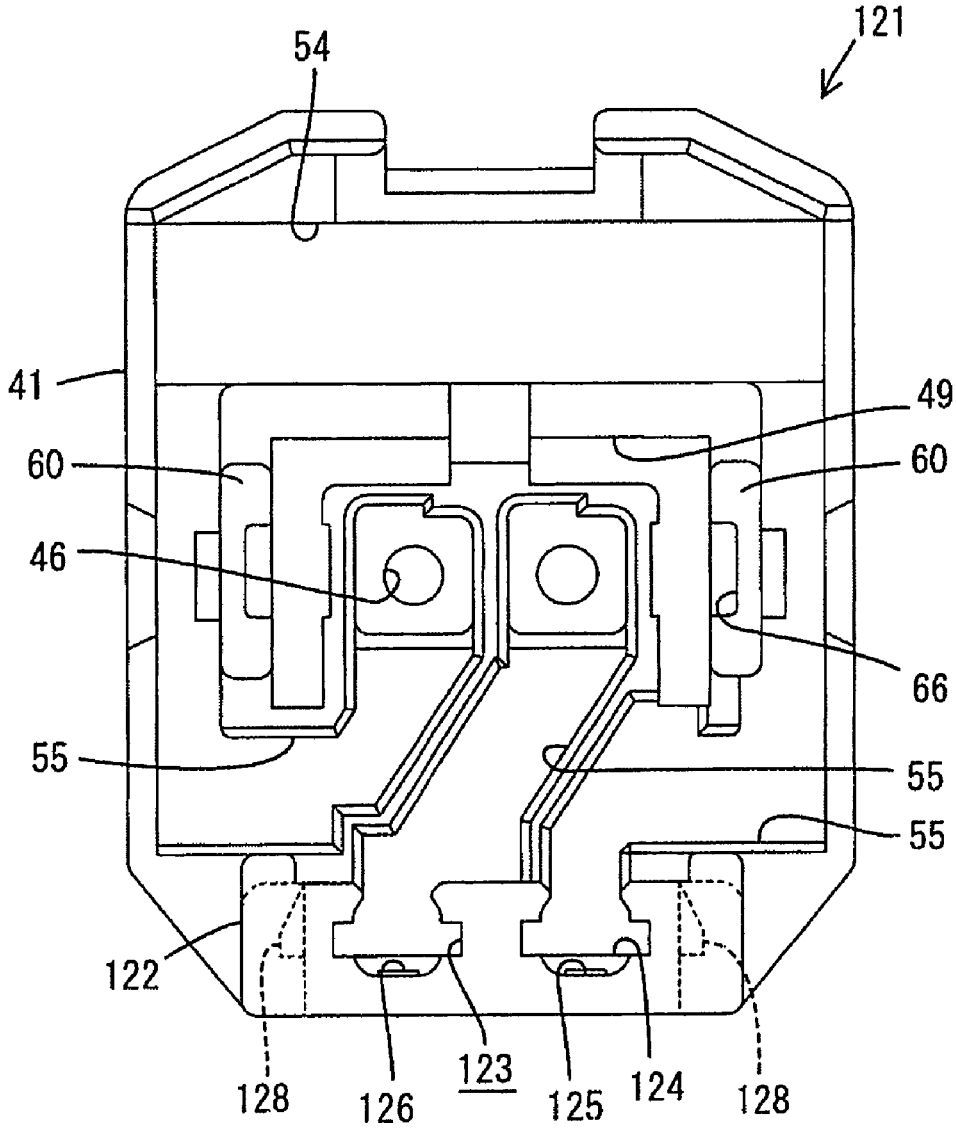
FIG. 19 is a rear view of a housing.
Figure 20:
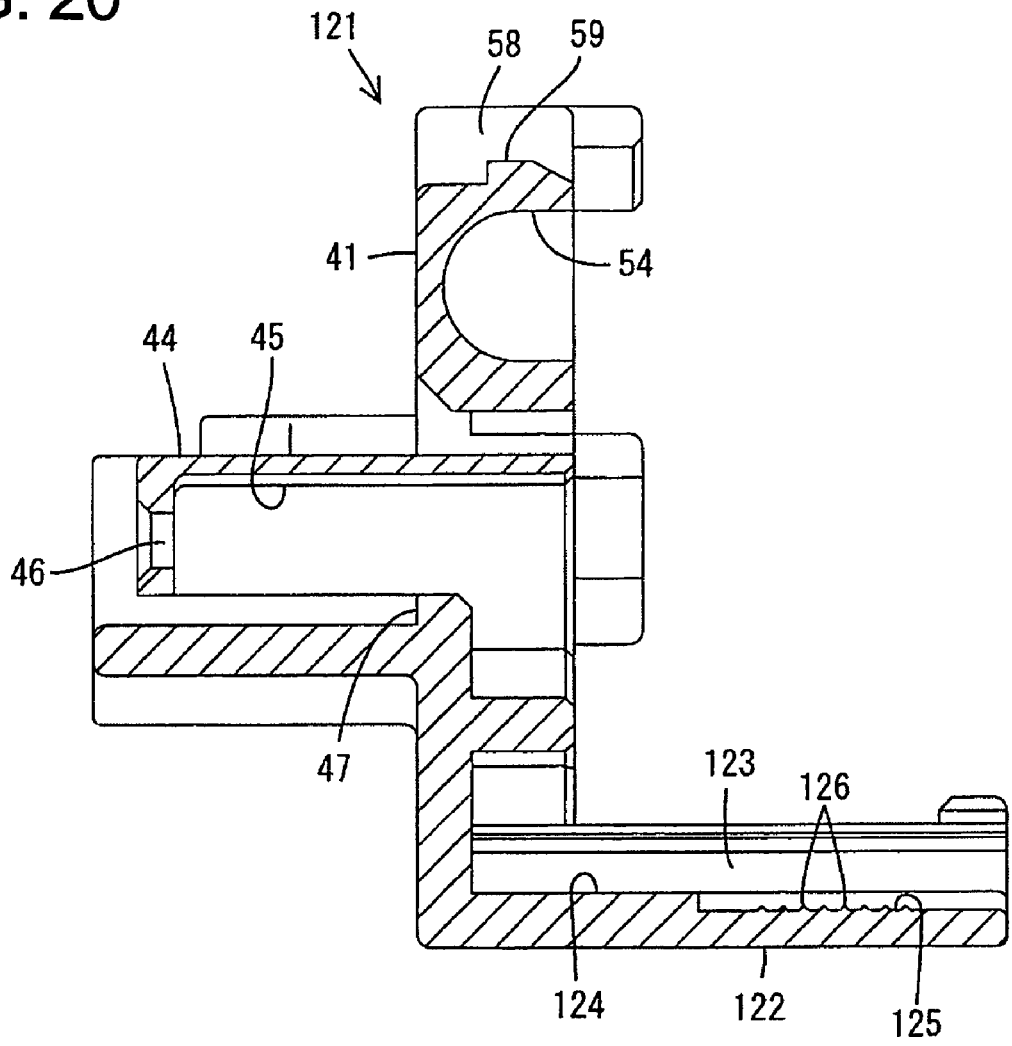
FIG. 20 is a vertical section of the housing.
Figure 21:
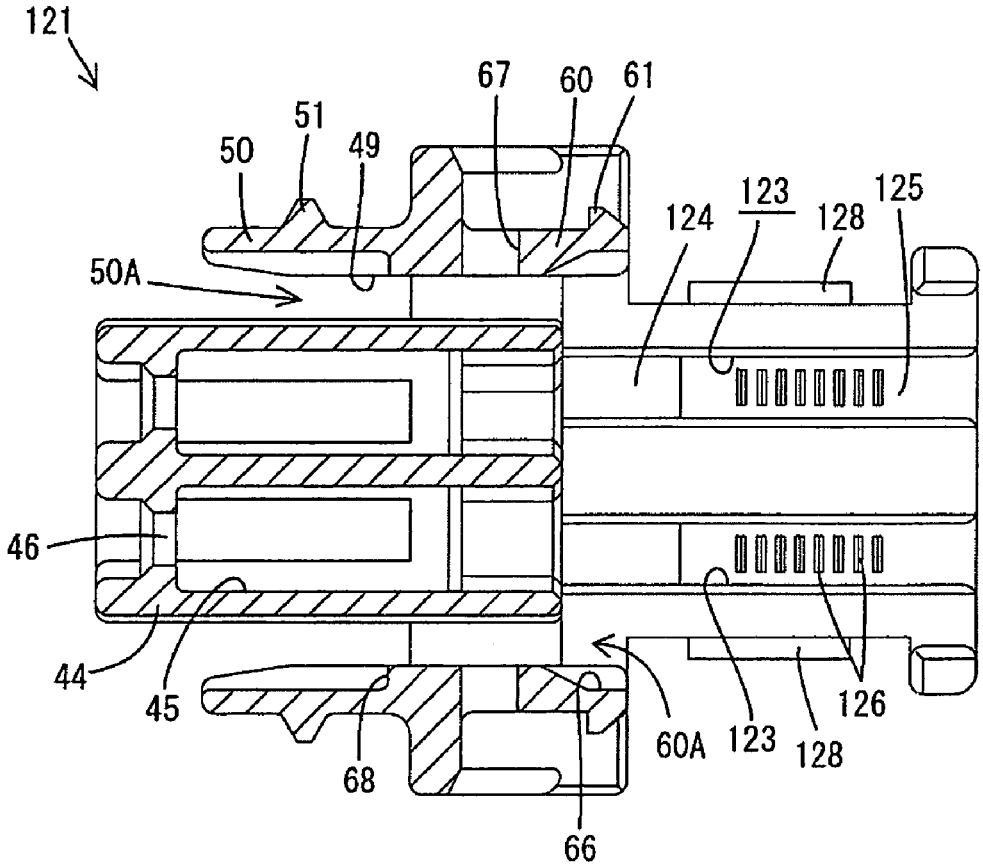
FIG. 21 is a horizontal section of the housing.

As shown in FIGS. 19 to 21, the housing 121 of the second connector 120 has an L shape formed by the terminal accommodating portion 41 and the wire accommodating portion 122 extending substantially orthogonal to each other. The terminal accommodating portion 41 has substantially the same shape as that of the first connector 20. Accordingly, the first cover 70 to be mounted on the rear surface of the terminal accommodating portion 41 and the detector 100 mounted on the rear surface of the first cover 70 also have the substantially the same shapes as those of the first connector 20. Thus, the first cover 70 and the detector 100 can be used commonly for the first and second connectors 20, 120.

On the other hand, the wire accommodating portion 122 extends substantially horizontally. Two accommodating grooves 123 are formed substantially side by side in the upper surface of the wire accommodating portion 122 and extend in substantially forward and backward directions FBD, as shown in FIG. 21, for accommodating the bent portion of the lead 25B of the second terminal fitting 21B and the wire 35 connected therewith, and the bent portion of the third terminal fitting 21C and the wire 35 connected therewith. As also shown in FIG. 24, the accommodating grooves 123 are slightly wider than the wire welding portions 27 and open in the rear surface of the wire accommodating portion 122. Further, the opening edges at the upper sides of the accommodating grooves 123 are narrowed to retain the wire welding portions 27.

A substantially flat surface 124 is formed at the front side of the bottom surface of each accommodating groove 123 to receive the part of the terminal fitting 22 before the wire welding portion 27. An arcuate surface 125 is provided adjacent the flat surface 124 to receive an insulation coating 37 of the wire 35. Biting projections 126 are formed at intervals along the longitudinal direction on the arcuate surface 125.

The third cover 130 is mounted to at least partly cover the upper, left and right surfaces of the wire accommodating portion 122 for holding the ends of the insulation coatings 37 of the wires 35.

Figure 22:
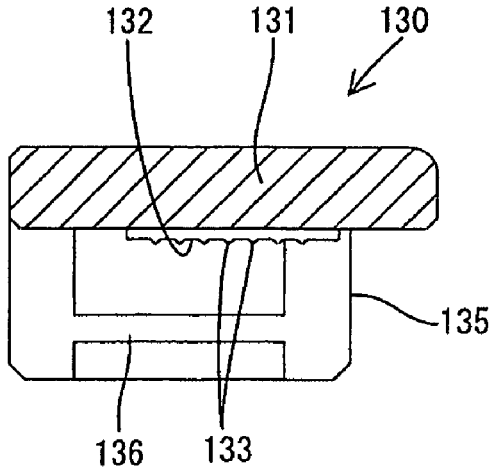
FIG. 22 is a vertical section of a third cover.
Figure 23:
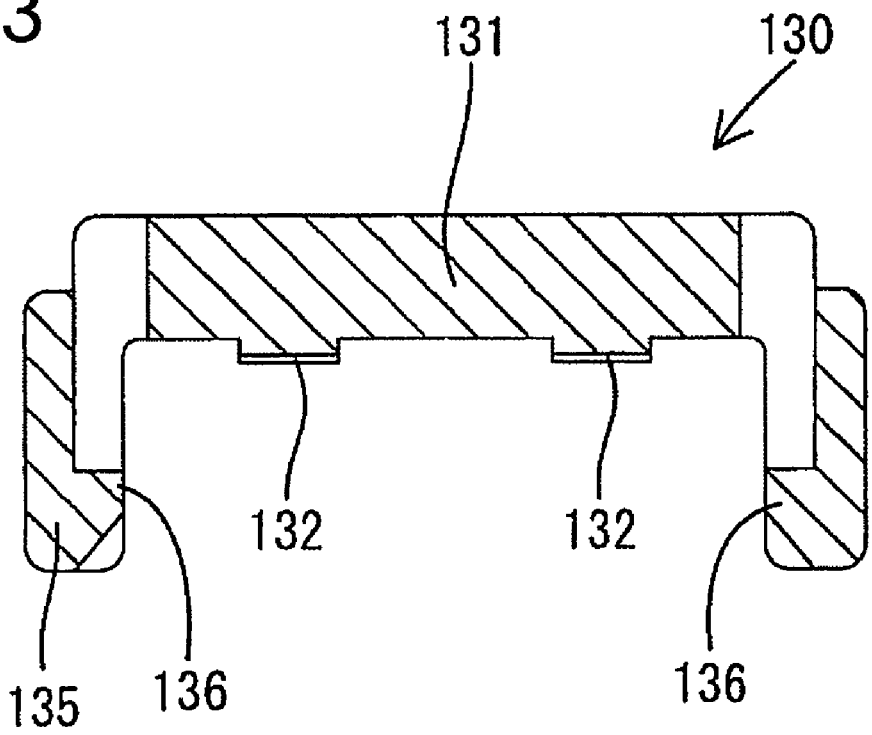
FIG. 23 is a horizontal section of the third cover.

As shown in FIGS. 22 and 23, two narrow squeezing portions 132 project from the lower surface of the main plate 131 of the third cover 130. The squeezing portions 132 are insertable into upper sides of the openings of the accommodating grooves 123 of the housing 121 to squeeze the ends of the insulation coatings 37 of the wires 35 in cooperation with the bottoms of the arcuate surfaces 125. The squeezing portions 132 have biting projections 133 formed on their outer surfaces.

Elongated lock projections 136 are formed at the projecting edges of the inner surfaces of side plates 135, engaging projections 128 are formed on the outer surfaces of the side walls of the wire accommodating portion 122 of the housing 121 to engage the lock projections 136.

Members that are common to the first connector 20 are identified by the same reference numerals, but are not described again.

The first connector 20 can be assembled as described above. More particularly, the coil 30, the terminal fittings 21A to 21C and the wires 35 are assembled on the inner surfaces of the first cover 70 and are connected by welding. This assembly then is mounted on the terminal accommodating portion 41 of the housing 40.

Figure 16:
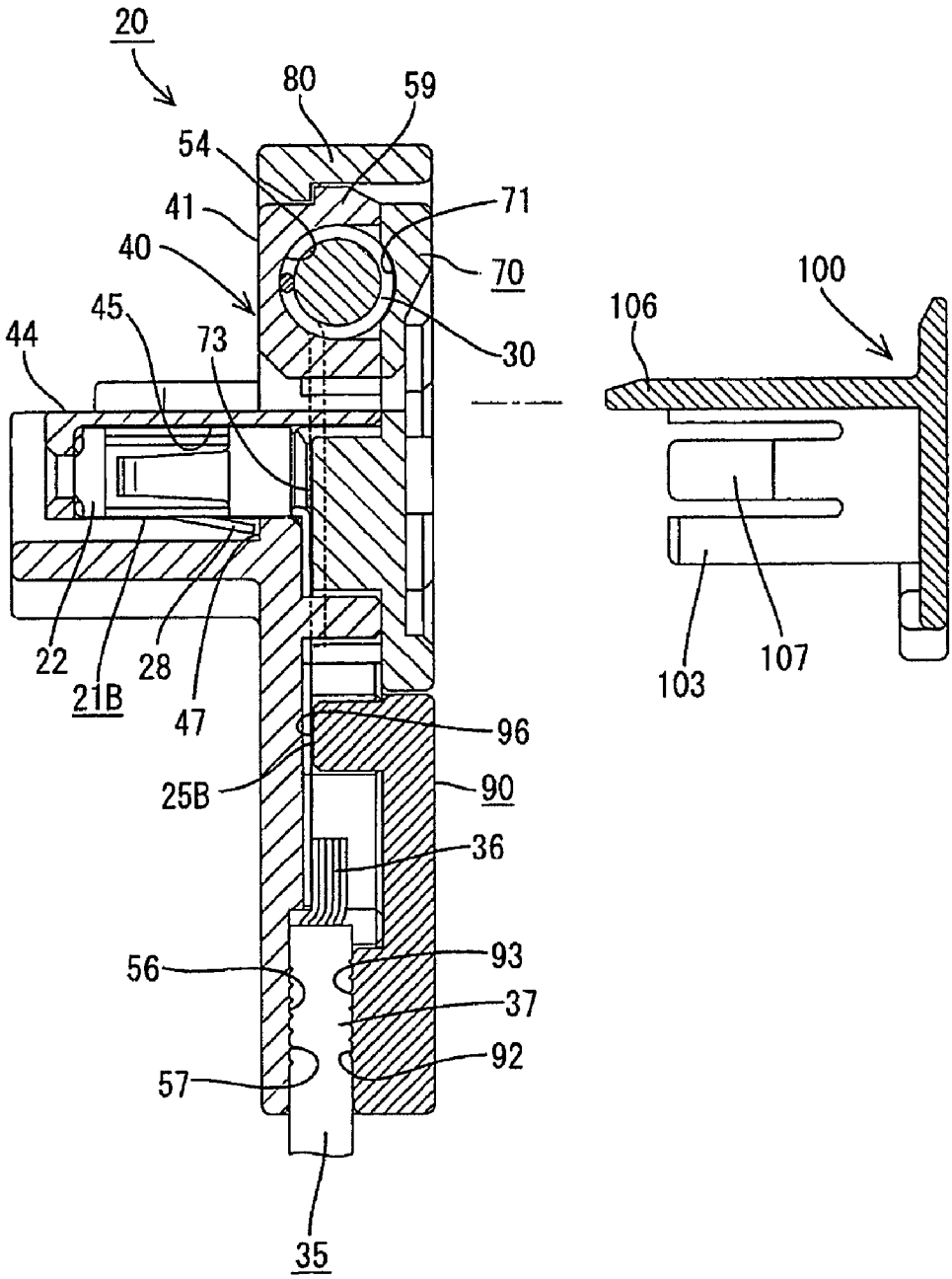
FIG. 16 is a vertical section showing the state of FIG. 15.
Figure 17:
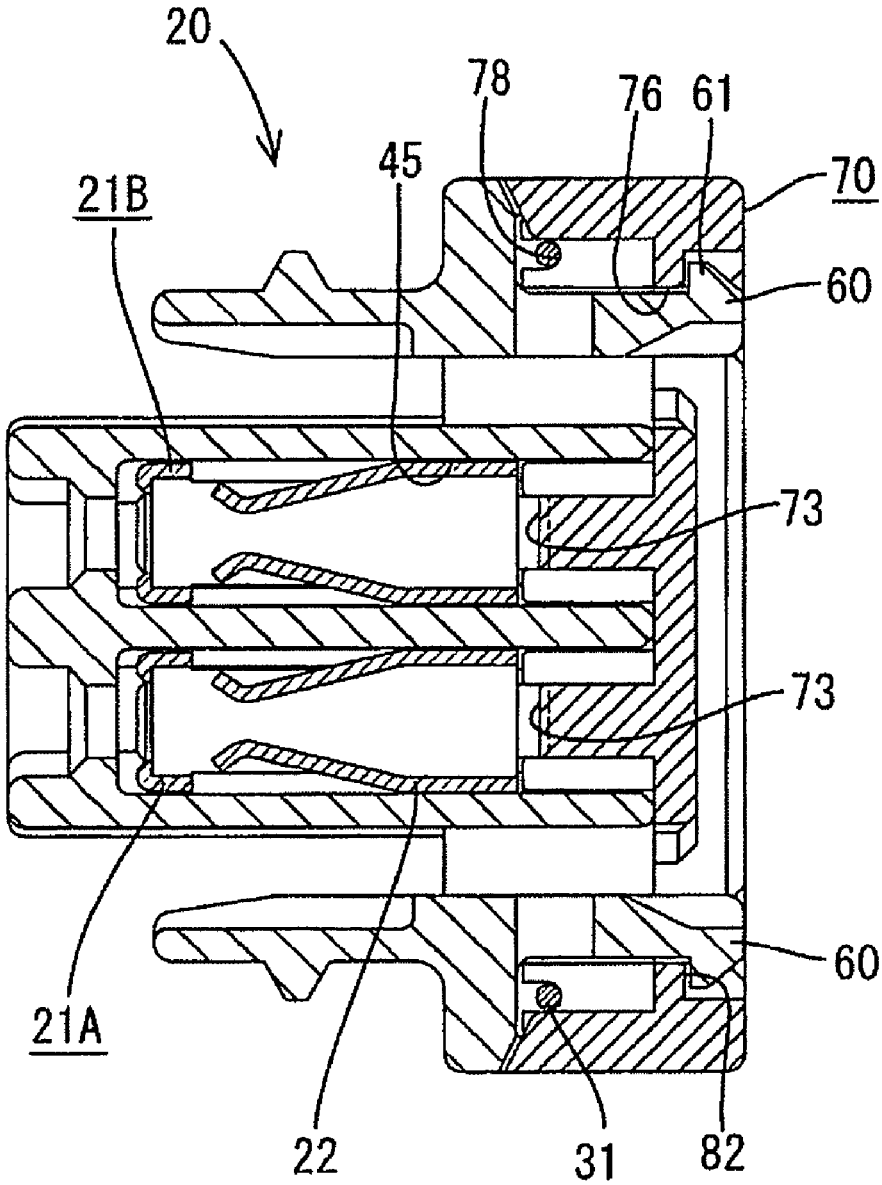
FIG. 17 is a horizontal section after assembling the first connector.

As shown in FIGS. 16 and 17, the upper locking piece 80 is pushed into the groove 58 of the housing 40 as the first cover 70 is mounted and the left and right guide ribs 83 are fit along the guide grooves 63. The upper locking piece 80 deforms resiliently at an intermediate stage to move onto the latch 59 and the cover locking pieces 60 of the housing 40 deform resiliently in due to the contact of the lock projections 61 with the outer edges of the left and right windows 76 from behind. Further, the female connecting portions 22 of the first and second terminal fittings 21A, 21B are inserted gradually into the corresponding cavities 45.

The hook 81 moves over the latch 59 when the first cover 70 is mounted properly and the upper locking piece 80 is restored resiliently so that the hook 81 engages the latch 59. Similarly, the lock projections 61 of the cover locking pieces 60 move over the side edges of the windows 76. Thus, the cover locking pieces 60 also are restored resiliently to fit the lock projections 61 into the left and right lock grooves 82. In this way, the first cover 70 is locked in its mounted state.

In the meantime, the female connecting portions 22 of the terminal fittings 21A, 21B are inserted properly into the cavities 45. Thus, the metal locks 28 engage the engaging portions 47 for partial locking, and the upper sides of the placing portions 73 of the first cover 70 engage the rear surfaces of the female connecting portions 22 for redundantly locking the female connecting portions 22.

The coil 30 is between the coil accommodating recess 54 and the holding recess 71 of the first cover 70. Further, the leads 25A, 25B of the first and second terminal fittings 21A, 21B and the third terminal fitting 21C are in the corresponding terminal accommodating grooves 55, and the ends of the insulation coatings 37 of the wires 35 are in the corresponding wire accommodating grooves 56 so that the wires 35 extend out from the bottom edge of the housing 40. Additionally, the placing portions 73 of the first cover 70 press and hold parts of the leads 25A, 25B of the terminal fittings 21A, 21B and a part of the third terminal fitting 25C.

The second cover 90 then is mounted on the rear surface of the wire accommodating portion 42 of the housing 40. The second cover 90 is pushed while the side plates are deformed in directions away from each other by the movements of the lock projections 97 onto the engaging projections 64 of the housing 40. When the second cover 90 is pushed by a specified amount, the side plates restore resiliently to engage the lock projections 97 with the engaging projections 64. In this way, the second cover 90 is locked.

The ends of the insulation coatings 37 of the wires 35 are squeezed between the squeezing portions 92 and the wire accommodating grooves 56 while the biting projections 93, 57 bite in these ends. Additionally, the pressing portions 96 press and hold a part of the lead 25B of the second terminal fitting 21B and a part of the third terminal fitting 21C.

Figure 28A:
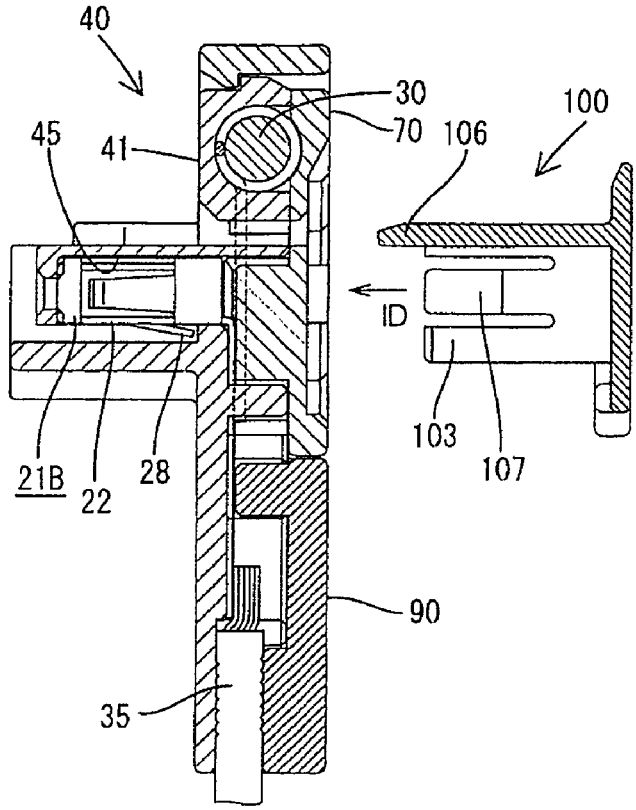
FIGS. 28(A) and 28(B) are vertical and horizontal sections showing a state before the detecting member is mounted into the first connector.
Figure 28B:
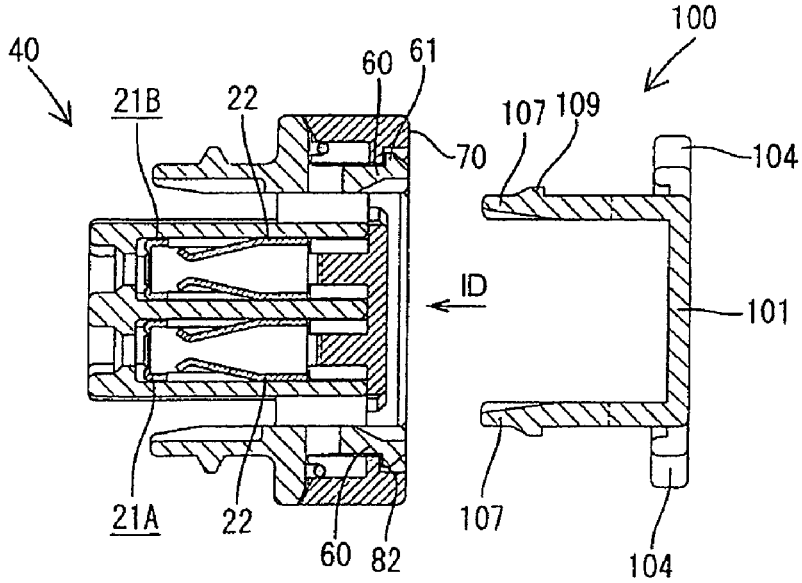

After the two covers 70, 90 are mounted, the detector 100 is inserted from behind and along the inserting direction ID into the windows 76 of the first cover 70, as shown by arrows in FIG. 28 and is held at the partial locking or standby position SP.

Figure 29A:
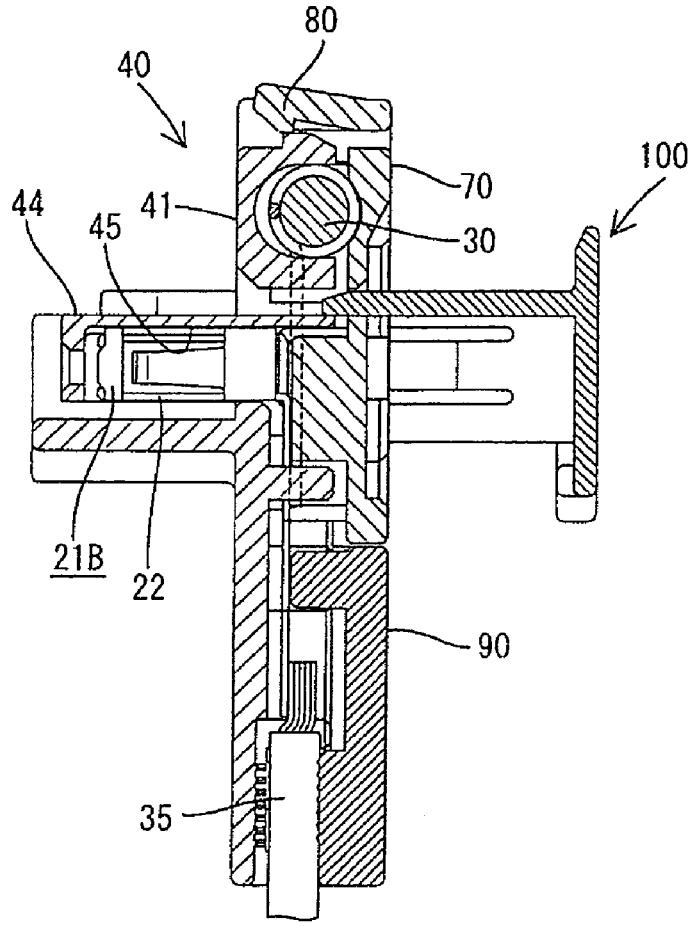
FIGS. 29(A) and 29(B) are vertical section and horizontal sections showing a case of detecting a partly locked state of the first cover.
Figure 29B:
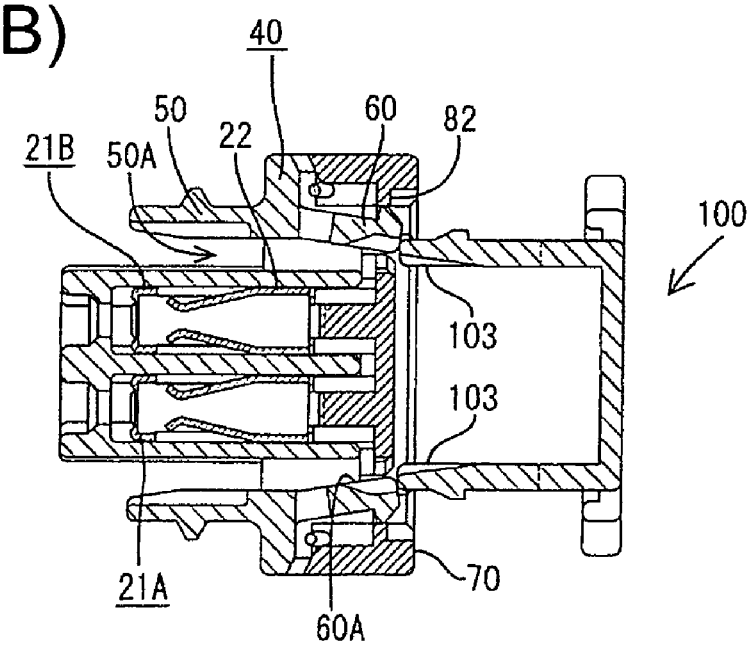

The first cover 70 will remain merely in a partly locked state, and the cover locking pieces 60 remain resiliently deformed in the deformation spaces 60A if the first cover 70 is not pushed by the specified amount. At this time, the female connecting portions 22 of the terminal fittings 21A, 21B may not be inserted sufficiently into the cavities 45 and may not be locked by the metal locks 28. In such a case, the leading ends of the detecting pieces 103 contact the leading ends of the resiliently deformed cover locking pieces 60, as shown in FIG. 29(B), when the detector 100 is inserted. As a result, the detector 100 cannot be inserted completely, and the partly locked state of the first cover 70 can be detected.

The first cover 70 then is pushed again to achieve a locked state and simultaneously to lock the female connecting portions 22 of the terminal fittings 21A, 21B in the cavities 45, as shown in FIG. 28.

The cover locking pieces 60 return to their initial positions and retract from the deformation spaces 60A when the first cover 70 is pushed by a proper amount, as described above. The detector 100 then can be pushed sufficiently for the holding projections 109 of the holding pieces 107 to be inserted through the insertion grooves 66 of cover locking pieces 60. As a result, the holding pieces 107 deform resiliently inward. The holding pieces 107 restore resiliently after the holding projections 109 move beyond the backs of the insertion grooves 66. As a result, the holding projections 109 fit into the partial locking holes 67 and the detector 100 is held at the partial locking or standby position SP. At this partial locking position SP, the front sides of the detecting pieces 103 stay in the deformation spaces 60A to prevent resilient deformation of the cover locking pieces 60. Therefore, the first cover 70 is locked doubly.

The tower 44 of the first connector 20 is fit into the guiding hole 12 of the housing 11 of the mating connector 10, as shown by the arrow CD in FIG. 30, while the detector 100 is at the partial locking position SP. The first connector 20 is pushed and the housing locking pieces 50 deform resiliently inward due to the contact of the lock projections 51 with the left and right opening edges of the housing 11. Simultaneously, the mating terminal pins 13 gradually enter the female connecting portions 22 of the first and second terminal fittings 21A, 21B. The lock projections 51 fit into the locking grooves 18 of the mating housing 11, as shown in FIG. 31, when the first connector 20 is fitted by a specified amount. Thus, the housing locking pieces 50 restore resiliently to lock the first connector 20.

The detector 100 is pushed in the inserting direction from the partial locking position SP to the full locking position MP after the first connector 20 is connected with the mating connector 10.

Figure 32A:
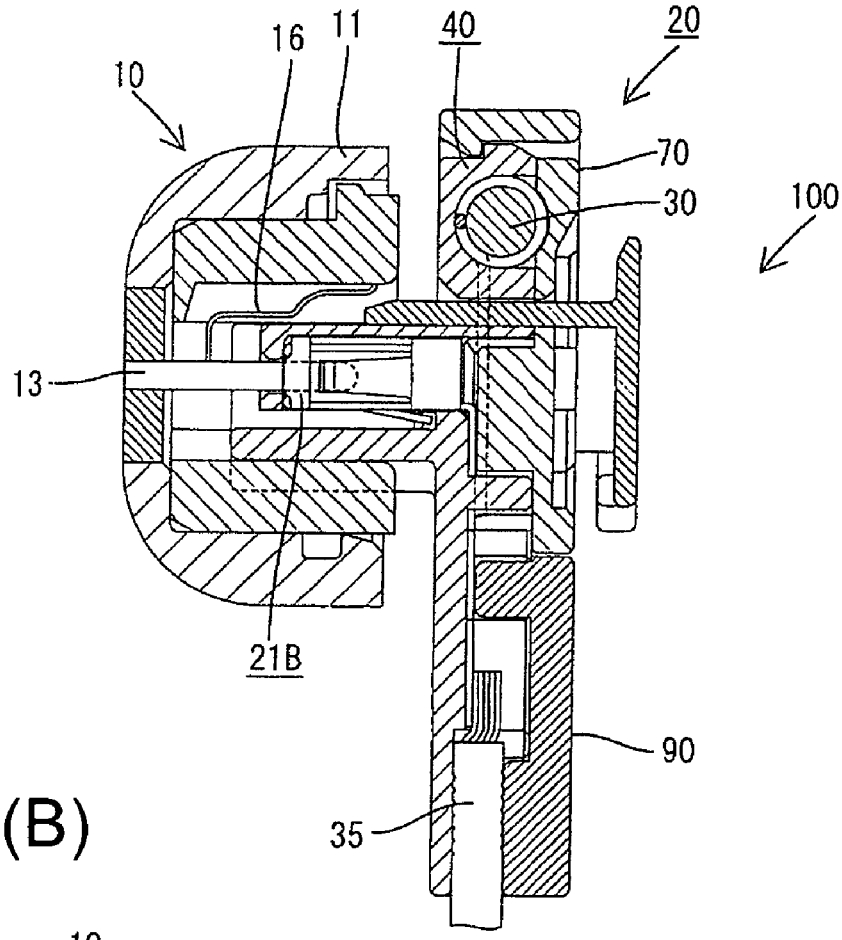
FIGS. 32(A) and 32(B) are vertical and horizontal sections showing a case of detecting a partly connected state of the first connector.
Figure 32B:
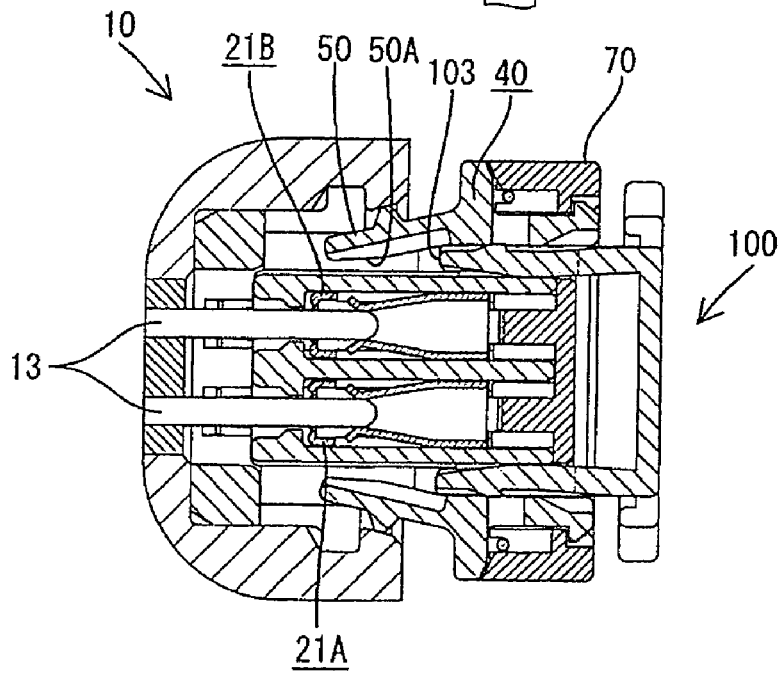

A first connector 20 that has not been pushed by the specified amount will not be locked and the housing locking pieces 50 will remain resiliently deformed towards the deformation spaces 50A, as shown in FIG. 32. In such a case, the leading ends of the detecting piece 103 contact the inner surfaces of the resiliently deformed housing locking pieces 50. As a result, the detector 100 cannot be inserted any further, and the partly locked state of the first connector 20 can be detected. The first connector 20 then may be pushed again.

The housing locking pieces 50 return to their initial positions and retract from the deformation spaces 50A when the first connector 20 is pushed by a proper amount to be locked. Thus, the holding pieces 107 deform resiliently and enter the deformation spaces 50A together with the detecting pieces 103. Thereafter, the holding pieces 107 restore resiliently, as shown in FIG. 33, and the holding projections 109 fit into the full locking holes 68. Thus, the detector 100 is held at the full locking position MP.

In the meantime, the female connecting portions 22 of the first and second terminal fittings 21A, 21B and the mating terminal pins 13 are connected properly. Additionally, the disengaging pieces 106 of the detector 100 push the slanted portions 16A of the contact pieces 16 of the shorting terminal 15 to deform the contact pieces 16 resiliently out, thereby disengaging the shorting terminal 15 from the terminal pins 13. In this way, the shorted state of the two terminal pins 13 is canceled.

Front ends of the detecting pieces 103 stay in the deformation spaces 50A for the housing locking pieces 50. Thus, the housing locking pieces 50 cannot deform and the housings 11, 40 are locked together redundantly. Similarly, rear ends of the detecting pieces 103 stay in the deformation spaces 60A for the cover locking pieces 60. Thus, the cover locking pieces 60 cannot deform and the first cover 70 is locked redundantly.

The second connector 120 is assembled and connected with the mating connector 10 in a manner similar to the first connector 20. More particularly, the coil 30, the terminal fittings 21A to 21C and the wires 35 are assembled on the inner surface of the first cover 70, as shown in FIG. 9, and are connected by welding. The lead 25B of the second terminal fitting 21B and the third terminal fitting 21C then are bent at right angles along the bending lines "s" so that the wires 35 extend back. In this state, the first cover 70 is mounted on the terminal accommodating portion 41 of the housing 121.

The first cover 70 is pushed while the upper locking piece 80 and the cover locking pieces 60 of the housing 121 deform resiliently. Further, the female connecting portions 22 of the first and second terminal fittings 21A, 21B are inserted gradually into the corresponding cavities 45.

Simultaneously, the lead 25B of the second terminal fitting 21B, the part of the third terminal fitting 21C from the bent portion to the wire connecting portion 27 and the wires 35 are inserted forward into the corresponding accommodating grooves 123 in the wire accommodating portion 122 of the housing 121 through the openings at the rear end.

Figure 26:
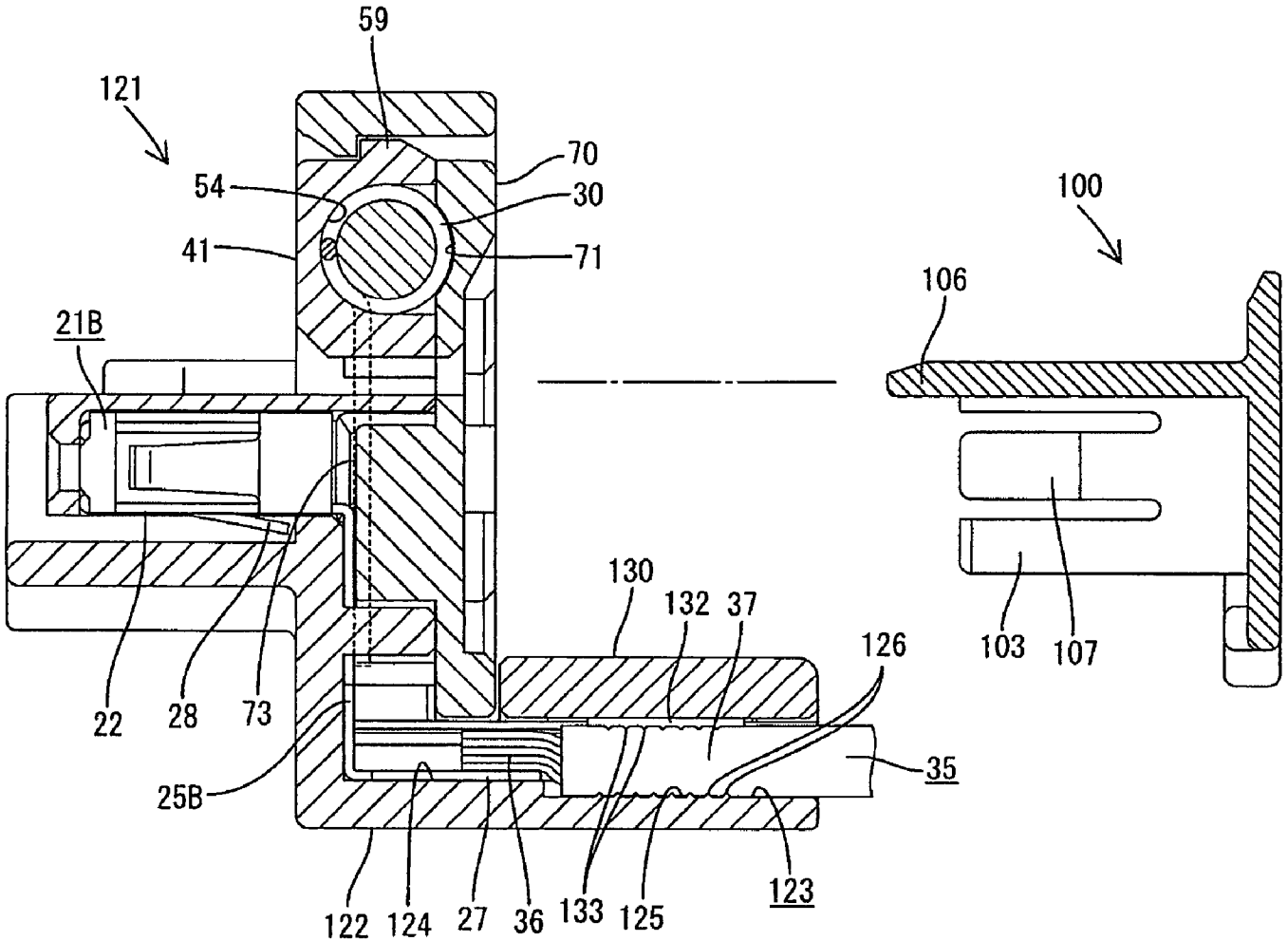
FIG. 26 is a vertical section showing the state of FIG. 25.

The upper locking piece 80 restores resiliently to engage the latch 59 and the cover locking pieces 60 fit into the left and right lock grooves 82 to lock the first cover 70 in its properly mounted state. In the meantime, the female connecting portions 22 of the terminal fittings 21A, 21B are inserted into the cavities 45 and are locked partly by the metal locks 28, as shown in FIG. 26. Additionally, upper sides of the placing portions 73 of the first cover 70 engage the rear surfaces of the female connecting portions 22 to lock the female connecting portions 22 doubly. Further, the coil 30 is held between the coil accommodating recess 54 and the holding recess 71 of the first cover 70, and upper sides of the leads 25A, 25B of the first and second terminal fittings 21A, 21B and the third terminal fitting 21C are accommodated in the corresponding terminal accommodating grooves 55 of the terminal accommodating portion 41 and are held by the placing portions 73 of the first cover 70.

The lead 25B of the second terminal fitting 21B and the part of the third terminal fitting 25C from the bent portion to the wire welding portion 27 are placed on the substantially flat surfaces 124 of the accommodating grooves 123 in the wire accommodating portion 122. Similarly, ends of the insulation coatings 37 of the wires 35 are placed on the arcuate surfaces 125.

The third cover 130 then is mounted on the upper surface of the wire accommodating portion 122 of the housing 121. The third cover 130 is pushed while the lock projections 136 of the side plates 135 move onto the engaging projections 128 of the housing 121 to deform the side plates 135 resiliently away from each other. The side plates 135 restore resiliently and the lock projections 136 engage the engaging projections 128 when the third cover 130 is pushed by a specified amount, thereby locking the third cover 130.

Simultaneously, the squeezing portions 132 in the third cover 130 are inserted into the upper sides of the openings of the accommodating grooves 123, and the ends of the insulation coatings 37 of the wires 35 are squeezed from substantially opposite sides and held between the squeezing portions 132 and the arcuate surfaces 125 of the accommodating grooves 123 while letting the biting projections 133, 126 bite in the insulation coatings 37.

The third cover 130 contacts the first cover 70 to hinder the mounting operation of the third cover 130 if the first cover 70 is mounted improperly. In such a case, the first cover 70 may be pushed again to be locked, and the third cover 130 may be mounted again.

After both covers 70, 130 are mounted, the detector 100 is inserted from behind and along the inserting direction ID into the windows 76 of the first cover 70, and is held at the partial locking position SP.

As described above, the partly locked state of the first cover 70 can be detected at the time of mounting the third cover 130. However, due to an assembling tolerance and the like, the first cover 70 may be kept partly locked even if the third cover 130 can be mounted. In such a case, the leading ends of the detecting pieces 103 contact the leading ends of the resiliently deformed cover locking pieces 60 to prevent further insertion of the detector 100. In this way, the partly locked state can be detected (see FIG. 29(B)). The first cover 70 then may be pushed again so that the first cover 70 is locked and the female connecting portions 22 of the terminal fittings 21A, 21B are locked partly by the metal locks 28 if the female connecting portions 22 are inserted insufficiently.

The cover locking pieces 60 return towards their initial positions to retract from the deformation spaces 60A when the first cover 70 is pushed by a proper amount. The detector 100 then is pushed while the holding pieces 107 are deformed resiliently and is held at the partial locking position SP by the engagement of the holding projections 109 with the partial locking holes 67 (see FIG. 30(B)). At this time, the front sides of the detecting pieces 103 stay in the deformation spaces 60A to prevent the resilient deformations of the cover locking pieces 60. Therefore, the first cover 70 is locked doubly.

With the detector 100 held at the partial locking position SP, the tower 44 of the second connector 120 is connected with the housing 11 of the mating connector 10 as in the first connector 20. The second connector 120 is pushed while the housing locking pieces 50 are resiliently deformed inward. As the second connector 120 is pushed, the female connecting portions 22 of the first and second terminal fittings 21A, 21B are gradually connected with the corresponding mating terminal pins 13. When the second connector 120 is connected by a specified amount, the lock projections 51 are fit into the locking grooves 18 of the mating housing 11 to lock the second connector 120 and the mating connector 10 together while the housing locking pieces 50 are resiliently restored (see FIG. 31(B)).

After completing the connecting operation of the second connector 120, the detector 100 at the partial locking position SP is pushed toward the full locking position MP. If the second connector 120 was pushed insufficiently, it may be left partly locked with the housing locking pieces 50 resiliently deformed toward the deformation spaces 50A. In such a case, the leading ends of the detecting pieces 103 contact the inner surfaces of the resiliently deformed housing locking pieces 50. Accordingly, the detector 100 cannot be inserted in the inserting direction ID any further. As a result, the partly locked state can be detected (see FIG. 32(B)) and the first cover 120 may be pushed again.

The housing locking pieces 50 return to their initial positions and retract from the deformation spaces 50A when the second connector 120 is pushed by a proper amount to be locked. Thus, the holding pieces 107 enter the deformation spaces 50A together with the detecting pieces 103 and deform resiliently inward. Thereafter, the holding pieces 107 are restored resiliently to fit the holding projections 109 into the full locking holes 68 so that the detector 100 is held at the full locking position MP (see FIG. 33(B)).

The female connecting portions 22 of the first and second terminal fittings 21A, 21B and the mating terminal pins 13 are connected properly, and the disengaging pieces 106 of the detector 100 engaged the contact pieces 16 of the shorting terminal 15 to disengage them from the terminal pins 13. In this way, the shorted state of the two terminal pins 13 is canceled.

Further, front sides of the detecting pieces 103 stay in the deformation spaces 50A for the housing locks 50 to prevent resilient deformations of the housing locks 50 for doubly locking the housings 11, 121 together. Additionally, rear sides of the detecting pieces 103 stay in the deformation spaces 60A for the cover locks 60 to prevent resilient deformations of the cover locks 60 for doubly locking the first cover 70.

As described above, the detector 100 can detect whether the first cover 70 was mounted properly as well as whether the first and second connectors 20, 120 are connected properly. Additionally the first cover 70 doubly locks the terminal fittings 21A, 21B in the cavities 45 by being properly mounted. Further, the detector 100 also detects the connected state of the housing 40, 121 of the first or second connector 20, 120 and the housing 11 of the mating connector 10. Thus, the number of parts is reduced and the housings 40, 121 and the first cover 70 are smaller.

The detecting pieces 103 function to make detection for the first cover 70 and for the housing 40 (121). Thus, the detector 100 can be smaller, and the mounting space for the detector 100 can be smaller.

The detector 100 can be held successively at the partial locking position SP and at the full locking position MP as it is inserted. The mounted state of the first cover 70 is detected as the detector 100 is inserted to the partial locking position SP, and the connected state of the housings 11, 40 (120) can be detected as the detector 100 is inserted to the full locking position MP. Thus, the two detecting operations can be performed easily and efficiently by a substantially continuous motion in the inserting direction ID.

With the detector 100 mounted at the partial locking position SP, the detecting pieces 103 hinder resilient deformations of the cover locks 60 by staying in the deformation spaces 60A. Thus, the first cover 70 can be locked doubly in its mounted state. Further, with the detector 100 at the full locking position MP, the detecting pieces 103 hinder resilient deformations of the housing locks 50 and the cover locks 60 by staying in both deformation spaces 50A, 60A. Thus, the first cover 70 and the housings 11, 40 (121) can be doubly locked.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The housing locking pieces and the cover locking pieces may be provided at distanced positions without being arranged one after the other. In such a case, the detector may be formed with separate detecting pieces insertable into the respective deformation spaces.

The detector may be inserted directly to the full locking position MP without being held temporarily at the partial locking position SP.

Although the terminal fittings, the coil and the wires are assembled on the first cover and the first cover is assembled with the housing in this state, they may be detached from the first cover and accommodated in the housing after being assembled. The first cover then may be mounted.

In the 90°-type connector, it is also possible to provide only one cover. The present invention is also applicable to such a connector.

The connection of the terminal fittings, the coil and the wires is not limited to the one by welding as described in the foregoing embodiment. They may be connected by soldering, crimping, insulation displacement, press-fitting, clamping or like means.

The invention is applicable to connectors in which only terminal fittings and wires are in a housing and other electrical components such as a coil or a shorting element are not accommodated therein.

What is claimed is:

1. A connector (20; 120), comprising:

a housing (40; 121) into which at least one terminal fitting (21) is accommodated, a cover (70) adapted to cover at least part of a rear surface of the housing (40; 121), at least one resiliently deformable cover lock (60) for locking the cover (70) in a mounted state, at least one resiliently deformable housing lock (50) for locking the housing (40; 121) and a mating housing (11) in a properly locked state, and a detector (100) mountable into the housing (40; 121) in an inserting direction (ID) and including a detecting piece (103) for the housing (40; 121) insertable into a deformation space (50A) for the housing lock (50) and a detecting piece (103) for the cover (70) insertable into a deformation space (60A) for the cover lock (60) as the detector (100) is mounted.

2. The connector of claim 1, wherein the deformation space (60A) for the cover lock (60) and the deformation space (50A) for the housing lock (50) are on a substantially common path and communicate with each other.

3. The connector of claim 1, wherein the detecting piece (103) for the cover (70) and the detecting piece (103) for the housing (40; 121) are defined by a single detecting piece (103) on the detector (100) that can be located in both of the deformation spaces (50A, 60A).

4. The connector of claim 1, wherein the detector (100) can be held at a standby position (SP) at a front side and at a mounted position (MP) reached by being further inserted from the standby position (SP).

5. The connector of claim 4, wherein the detecting piece (103) for the cover (70) is insertable into the deformation space (60A) for the cover lock (60) when the detector (100) is inserted to the standby position (SP) while the detecting piece (103) for the housing (40; 121) is insertable into the deformation space (50A) for the housing lock (50) when the detector (100) is inserted to the mounted position (MP).

6. The connector of claim 5, wherein the detecting piece (103) for the cover (70) prevents resilient deformation of the cover lock (60) by staying in the deformation space (60A) for the cover lock (60) when the detector (100) is at the standby position (SP).

7. The connector of claim 6, wherein the detecting piece (103) for the housing (40; 121) prevents resilient deformation of the housing lock (50) by staying in the deformation space (50A) for the housing lock (50) with the detector (100) is at the mounted position (MP).

8. The connector of claim 7, wherein the detecting piece (103) for the cover (70) continues to stay in the deformation space (60A) for the cover lock (60) to prevent resilient deformation of the cover lock (60) with the detector (100) at the mounted position (MP).

9. The connector of claim 1, wherein the detecting piece (103) interrupts a short-circuit provided by a shorting element (15) when mounted to the housing (40; 121) at a mounted position (MP).

10. The connector of claim 1, wherein the terminal fitting (21) and a wire drawing direction are substantially at right angles.

11. The connector of claim 1, wherein the terminal fitting (21) and a wire drawing direction are substantially aligned.

* * * * *